United States Patent [19]

Wachi et al.

[11] Patent Number: 4,703,680

[45] Date of Patent: Nov. 3, 1987

[54] TRUNCATE PRIORITIZATION SYSTEM FOR MULTI CHANNEL ELECTRONIC MUSIC GENERATOR

[75] Inventors: Masatada Wachi; Takeo Shibukawa, both of Hamamatsu, Japan

[73] Assignee: Nippon Gakki Seizo Kabushiki Kaisha, Hamamatsu, Japan

[21] Appl. No.: 855,610

[22] Filed: Apr. 23, 1986

[30] Foreign Application Priority Data

| | | | |
|---|---|---|---|
| Apr. 24, 1985 | [JP] | Japan | 60-086552 |
| May 24, 1985 | [JP] | Japan | 60-112907 |
| Jul. 24, 1985 | [JP] | Japan | 60-163133 |
| Oct. 17, 1985 | [JP] | Japan | 60-232241 |

[51] Int. Cl.[4] ..... G10H 1/22; G10H 7/00

[52] U.S. Cl. ..... 84/1.26; 84/DIG. 2; 84/1.01; 340/365 S; 340/825.5; 328/137; 328/154; 307/231

[58] Field of Search ..... 84/1.01, 1.13, 1.26, 84/DIG. 2; 340/365 S, 825.5; 307/231; 328/137, 154

[56] References Cited

U.S. PATENT DOCUMENTS

| | | | |
|---|---|---|---|
| Re 31,931 | 7/1985 | Tomisawa | 84/1.01 |
| 4,041,826 | 8/1977 | Oya | 84/1.01 |
| 4,335,639 | 6/1982 | Okamoto | 84/1.01 |
| 4,357,849 | 11/1982 | Ezawa et al. | 84/1.01 |
| 4,481,851 | 11/1984 | Swain et al. | 84/1.01 |
| 4,570,520 | 2/1986 | Deutsch et al. | 84/1.01 |

FOREIGN PATENT DOCUMENTS 57-136698 8/1982 Japan .

*Primary Examiner*—S. J. Witkowski

*Attorney, Agent, or Firm*—Spensley, Horn Jubas & Lubitz

[57] ABSTRACT

An electronic musical instrument comprises a keyboard for generating tone data or key codes each representative of a tone to be generated and a tone generating circuit having a plurality of tone generating channels. The electronic musical instrument also comprises a RAM having a plurality of storing positions for storing the key codes each of which is assigned under the control of a central processing unit (CPU) to a respective one of the tone generating channels to thereby generate a tone determined by the assigned key code. When a key is newly depressed on the keyboard, each of the key codes stored in the RAM is read therefrom and supplied to an envelope generator which in turn generates data representative of an amplitude of each of the envelopes given to the tones. The key codes read from the RAM are also supplied to a ROM to read therefrom weighting data. The CPU modifies each of the envelope amplitude data based on a respective one of the weighting data, and selects one of the key codes stored in the RAM in accordance with the modified envelope data. Then, the CPU replaces the selected key code in the RAM by the key code generated in response to the new depression of the key.

39 Claims, 34 Drawing Figures

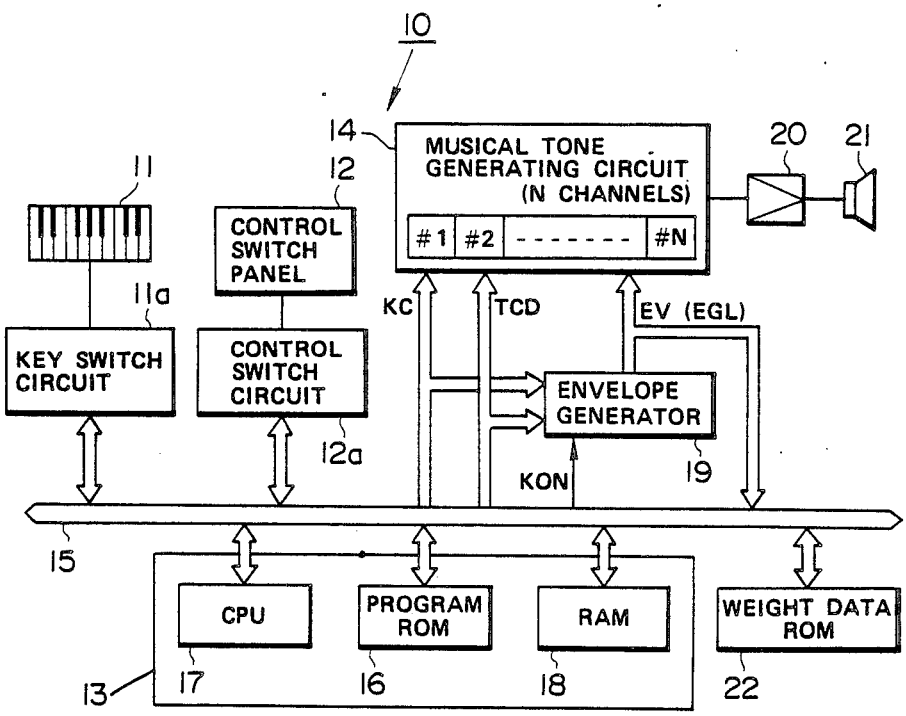
FIG. 1
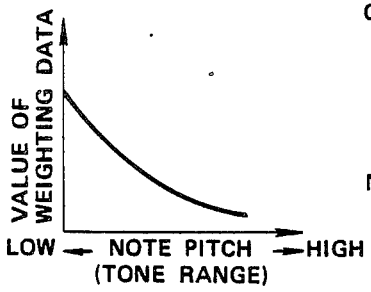
FIG.2
| | KCR | KOR |
|---|---|---|
| CH 1 | KCR (1) | KON (1) |
| 2 | KCR (2) | KON (2) |
| | ⋮ | ⋮ |
| N−1 | KCR (N−1) | KON (N−1) |
| N | KCR (N) | KON (N) |
| GNR |
|---|
| KCODE |
| EL |
| ACH |
| KCH |
| WL |
| ⋮ |
FIG.3

TRUNCATE PRIORITIZATION SYSTEM FOR MULTI CHANNEL ELECTRONIC MUSIC GENERATOR

BACKGROUND OF THE INVENTION

1. Field of the Invention

The present invention relates generally to an electronic musical instrument, and in particular to a polyphonic electronic musical instrument having a truncate function.

2. Prior Art

There have been proposed electronic keyboard musical instruments which have a plurality of tone generating channels for simultaneously generating tones corresponding to keys depressed on the keyboard. In such conventional musical instruments, when a key is newly depressed while all of the tone generating channels are generating tones, an assignment of the tone of the newly depressed key to the tone generating channels has been performed in one of the following methods.

One of the methods is disclosed in U.S. Pat. No. Re. 31,931 in which amplitudes of envelope waveforms for controlling levels of tones generated by respective tone generating channels are compared with each other, to detect the channel to which the envelope waveform of the smallest amplitude is applied, i.e., the channel which is generating the tone whose tone level is the lowest. Then, generation of the tone designated by the newly depressed key is assigned to the detected channel, whereby the tone corresponding to the newly depressed key begins to be generated instead of the tone which has been generated by the same tone generating channel. Another known method is disclosed in U.S. Pat. No. 4,041,826 in which counter means is provided for each of tone generating channels. And, each time a key assigned to one of the tone generating channels is released, the counter means of that channel corresponding to this released key and the counter means of those channels corresponding to keys, which have already been released, are incremented by the same value so that the contents of each counter means indicate the order of releasing of the corresponding key. When a key is newly depressed while all the channel are generating tones, the contents of all of the counter means are compared with each other to detect the counter means which contains the greatest value, whereby the tone generating channel corresponding to the earliest released key is detected. Then, the newly depressed key is assigned to the detected channel to cause it to generate a tone of the newly depressed key instead of the tone which has been generated by the same tone generating channel. A still another conventional method is shown in Japanese Patent Application Laid-Open No. 57-136698, in which envelope level data, which simulate decays of envelope waveforms of tones generated by respective tone generating channels, are compared with each other to detect the channel which is generating the tone most decayed. When a key is newly depressed on the keyboard, the newly depressed key is assigned to the detected tone generating channel to cause it to generate the tone of the newly depressed key instead of the tone which has been generated by the same tone generating channel.

Thus, with the conventional methods, when a key is newly depressed on the keyboard while all the tone generating channels are generating tones, the tone of the newly depressed key begins to be generated by the tone generating channel which has been generating the tone of the lowest tone level, the tone corresponding to the earliest released key, or the tone whose envelope level data is the smallest. When one performs a music with, for example, a piano, it is often required to perform the music in such a manner that tones in the higher tone range are produced one after another at shorter time intervals while aftersound of a tone in a lower tone range is still being produced. With the conventional methods, however, it has been impossible to achieve such a performance. More specifically, to achieve such a performance, a key corresponding to the tone in the lower tone range is first released, and then keys corresponding to the tones in the higher tone range are depressed one after another. And therefore, it is possible that the tone in the lower tone range is detected as the tone of the lowest level when one of the keys in the higher tone range is depressed. It is also possible that the envelope level data of the tone in the lower tone range becomes the smallest of all when one of the keys in the higher tone range is depressed. Further, there is a possibility that the tone in the lower tone range is detected as the tone whose key is the earliest released key. As a result, generation of the tone in the lower tone range is forcibly stopped. Such phenomena are conspicuous particularly when the decaying time of each tone is controlled in accordance with the tone pitch or tone range of the tone. Thus, with the conventional methods, it has been impossible to achieve a performance of a music equal in effect to that achieved with a piano.

As described above, with the conventional electronic musical instruments, it has been impossible to cause a specific one of tones generated respectively by all the tone generating channels to continue to be generated irrespective of the tone level or order of releasing of the corresponding key of the specific tone.

SUMMARY OF THE INVENTION

It is therefore an object of the present invention to provide an electronic musical instrument having a predetermined number of tone generating channels in which tones each to be generated with a long decay time can be fully generated even when many other tones are required to be generated one after another at short time intervals.

It is another object of the invention to provide such an electronic musical instrument in which a new tone to be generated can be assigned to the tone generating channel which is generating one of decaying tones other than a specific decaying tone when all of the tone generating channels are generating tones.

It is a further object of the invention to provide such an electronic musical instrument in which a new tone to be generated can be assigned to the tone generating channel which is generating one of decaying tones other than those belonging to a specific tone range when all of the tone generating channels are generating tones.

It is a further object of the invention to provide such an electronic musical instrument in which a new tone to be generated can be assigned to one of the tone generating channels always at a proper priority even when the channels generate tones having different decay times.

According to a first aspect of the invention, there is provided an electronic musical instrument comprising tone data generating means for generating tone data each representative of a tone to be generated; tone generating means having a plurality of tone generating channels; assigning means for assigning the tone data to the tone generating channels, each of the tone generating channels being assigned one of the tone data; truncate data generating means for generating a group of truncate data each relating to a respective one of the tone data; and modifying means for modifying each of the group of truncate data in accordance with a respective one of the tone data assigned to the plurality of tone generating channels, to thereby produce a group of modified truncate data; the tone data generating means further generating new tone data representative of a new tone; and the assigning means comprising channel designating means which designates a specific one of the tone generating channels in accordance with the group of modified truncate data and further assigning the new tone data to the specified channel so that the new tone data is substituted for the assigned one in the specific channel.

According to a second aspect of the invention, there is provided an electronic musical instrument comprising tone data generating means for generating tone data each representative of a tone to be generated; tone generating means having a plurality of tone generating channels; assigning means for assigning the tone data to the tone generating channels, each of the tone generating channels being assigned one of the tone data; the tone data generating means further generating new tone data representative of a new tone; and channel detecting means for detecting, in accordance with the tone data, at least one of the tone generating channels which is to be prevented from a new assignment of the new tone data; the assigning means further assigning the new tone data to one of remaining tone generating channels which are the tone generating channels except for the at least one of detected tone generating channel.

According to a third aspect of the invention, there is provided an electronic musical instrument comprising tone data generating means for generating tone data each representative of a tone to be generated; tone generating means having a plurality of tone generating channels; assigning means for assigning the tone data to the tone generating channels, each of the tone generating channels being assigned one of the tone data; the tone data generating means further generating new tone data representative of a new tone; truncate data storing means having storing portions corresponding to the tone generating channels for storing a group of truncate data; and new truncate data generating means responsive to the new tone data for generating new truncate data; the assigning means comprising channel designating means which designates a specified channel of the tone generating channels in accordance with the group of truncate data and further assigning the new tone data and the new truncate data to the specified channel and to a storing portion corresponding to the specified channel among the storing portions, respectively, so that the new tone data and the new truncate data are substituted for the assigned one in the specified channel and the stored one in the one corresponding to the specified channel among the storing portions.

BRIEF DESCRIPTION OF THE DRAWINGS

FIG. 1 is a block diagram of an electronic musical instrument 10 provided in accordance with a first embodiment of the invention;

FIG. 2 is a graph showing the relation between a note pitch (or a note range) and a value of the weighting data read from the weight data ROM 22 shown in FIG. 1;

FIG. 3 is an illustration showing various registers provided in the RAM 18 shown in FIG. 1;

DESCRIPTION OF THE PREFERRED EMBODIMENTS OF THE INVENTION

Figure 4:
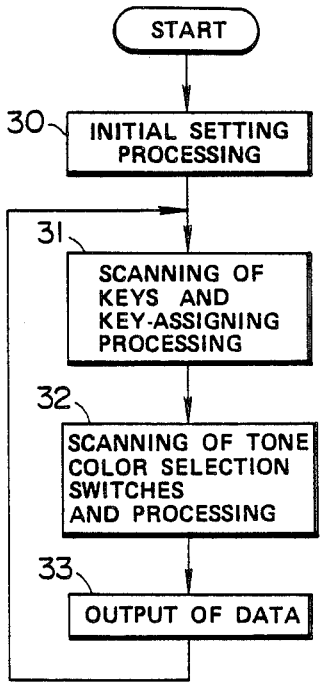
FIG. 4 is a flow chart of the main routine executed by the central processing unit (CPU) 17 shown in FIG. 1.

A first embodiment of the present invention will now be described with reference to FIGS. 1 to 6.

FIG. 1 is a block diagram of an electronic musical instrument 10 provided in accordance with the first embodiment of the invention. The electronic musical instrument 10 comprises a keyboard 11 having a plurality of keys each for designating a pitch of a tone to be generated and a control switch panel 12 which includes a plurality of switch levers (or buttons) for selecting tone colors, tone volumes and the like of tones to be generated. The electronic musical instrument 10 further comprises a microcomputer section 13 which controls a musical tone generating circuit 14 in accordance with outputs from the keyboard 11 and the control switch panel 12.

The keyboard 11 is connected to a key switch circuit 11*a* which comprises a plurality of key switches corresponding respectively to the keys on the keyboards 11. Each of the key switches is closed when the corresponding key on the keyboard 11 is depressed. Outputs of the respective key switches of the key switch circuit 11*a* are supplied to the microcomputer section 13 through a signal bus 15. The control switch panel 12 is connected to a control switch circuit 12*a* which comprises a plurality of control switches, whose ON/OFF states are determined respectively by the switch levers for controlling tone colors, and variable resistors whose resistance values are determined by the switch levers for controlling tone volumes. Outputs of the control switch circuit 12*a* are supplied through the signal bus 15 to the microcomputer section 13.

The microcomputer section 13 comprises a program ROM (read only memory) 16 for storing programs which will be described later, a central processing unit (hereinafter referred to as "CPU") 17 for executing the programs and a RAM (random access memory) 18 having therein working areas for temporarily storing data and variables necessary for executing the programs. The CPU 17 begins to execute the programs when power is supplied to this electronic musical instrument 10.

The CPU 17 scans the key switches in the key switch circuit 11*a* to detect depression and release of keys on the keyboard 11 and outputs key codes KC representative of such keys together with key-on signals KON. The key-on signal KON is a signal which is "1" when the corresponding key is depressed or being depressed, and is "0" when the corresponding key is released or not depressed. The CPU 17 also scans the switches in the control switch circuit 12*a* to detect the selected tone color, and outputs tone color data TCD representative of the selected tone color.

The key codes KC and the tone color data TCD are supplied through the signal bus 15 to the musical tone generating circuit 14 which has a plurality of tone generating channels (the number of channels is "N" in this embodiment) each for generating a tone. In this case, the key codes KC are assigned to different ones of the tone generating channels, and only those of the channels to which the key codes KC are assigned generate tones determined respectively by the assigned key codes KC. The key codes KC and the tone color data TCD are also supplied together with the key-on signal KON to an envelope generator 19. The envelope generator 19 generates an envelope signal EV having a waveshape determined by the tone color data TCD with respect to each of the key codes KC, and outputs the generated envelope signals EV respectively to the corresponding tone generating channels of the musical tone generating circuit 14 to thereby control amplitude envelopes of the respective tones. Thus, the tone generating channels of the musical tone generating circuit 14 generate musical tone signals having pitches determined respectively by the key codes KC assigned thereto, and amplitudes of the thus generated musical tone signals are controlled in accordance with the envelope signals EV, respectively. The musical tone signals outputted from the musical tone generating circuit 14 are amplified by an amplifier 20 and thence supplied to a loudspeaker 21 to thereby generates musical sounds.

The envelope generator 19 also outputs envelope level data EGL representative of a current level or amplitude of the envelope signal EV with respect to each of the tone generating channels. The envelope level data EGL are supplied through the signal bus 15 to the microcomputer section 13.

Also connected to the signal bus 15 is a weight data ROM 22 for storing a series of weighting data. The key codes KC or data representative of pitches of the tone to be generated by the musical tone generating circuit 14 are supplied to the weight data ROM 22 as address data. Alternatively, data representative of tone ranges to which tones to be generated belong, respectively, are supplied to the weight data ROM 22 as the address data. The weighting data are stored in the weight data ROM 22 as shown in FIG. 2 wherein the abscissa represents the tone pitch or tone range applied to the weight data ROM 22 as the addressing data, and the ordinate represents each value of the weighting data read from the ROM 22. As will be seen from FIG. 2, the higher the tone pitch or the tone range, the smaller the value of the read weighing data. The weighting data stored in the weight data ROM 22 are used for giving proper weights to the envelope level data EGL so that the channel generating the most decayed tone is detected in accordance with weighted envelope level data EGL'.

The RAM 18 comprises, as shown in FIG. 3, a key-code register area KCR for storing key codes KC indicative of the keys assigned to the respective tone generating channels, a key-on register area KOR for storing states of the keys assigned to the respective tone generating channels, and a general register area GNR for storing other data.

The key-code register area KCR comprises first to Nth key-code registers KCR(1) to KCR(N) corresponding respectively to the first to Nth tone generating channels of the musical tone generating circuit 14. Each of the key-code registers KCR(1) to KCR(N) stores therein the key code KC of the key assigned to the corresponding tone generating channel. In this embodiment, the key code KC takes a greater value when it represents a key of a higher-pitch tone, and takes a smaller value when it represents a key of a lower-pitch tone.

The key-on register area KON comprises first to Nth key-on registers KON(1) to KON(N) corresponding respectively to the first to Nth tone generating channels of the musical tone generating circuit 14. Each of the key-on registers KON(1) to KON(N) stores therein data representative of the key-on signal KON of the key assigned the corresponding tone generating channel. Each of the data or key-on data is "1" when the corresponding key is depressed or being depressed, and is "0" when the corresponding key is released or not depressed.

The general register area GNR includes a key-code register KCODE, an envelope level register EL, a truncate channel register ACH, a channel number register KCH, a weight data register WL and other registers. The key-code register KCODE stores therein the key-code KC of the key which is currently scanned by the CPU 17. The envelope level register EL stores therein the smallest one of the envelope level data EGL corresponding respectively the tone generating channels. The truncate channel register ACH stores a channel number of that channel to which the smallest envelope level data is outputted. The channel number register KCH stores a channel number of that channel with respect to which the microcomputer section 13 is currently effecting processing of data. The weight data register WL stores one of the weighting data which is read from the weight data ROM 22.

Figure 5:
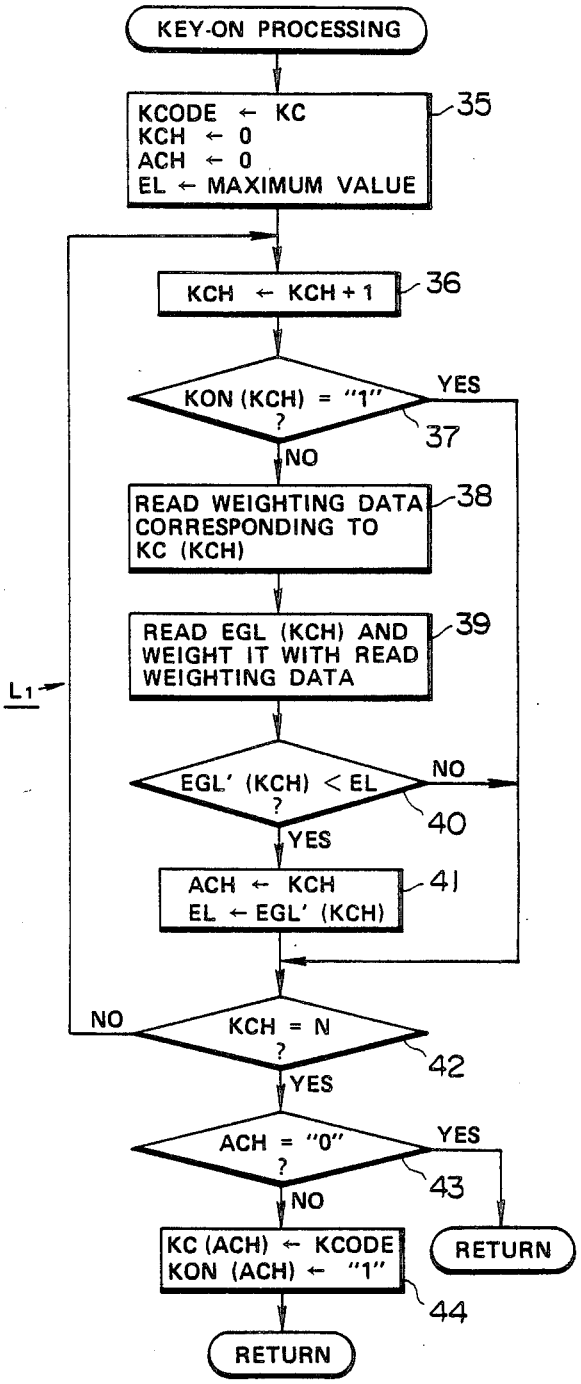
FIG. 5 is a flow chart of the key-on processing routine executed at the step 31 shown in FIG. 4.
Figure 6:
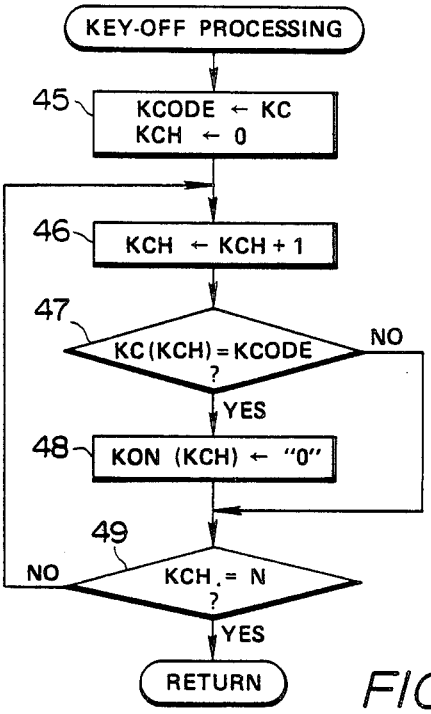
FIG. 6 is a flow chart of the key-off processing routine executed at the step 31 shown in FIG. 4.

FIGS. 4 to 6 are flow charts showing the processing effected by the microcomputer section 3. The operation of this electronic musical instrument 10 will now be described with reference to these flow charts.

When power is supplied to this electronic musical instrument 10, the CPU 17 begins to execute the program at step 30 of the flow chart of FIG. 4, wherein the CPU 17 effects an initial setting to the various registers provided in the RAM 18. At the next step 31, the CPU 17 scans the key switches of the key switch circuit 11*a* to detect depression and release of keys on the keyboard 11, and then effects key-assigning processing which will be later described with reference to the flow charts shown in FIGS. 5 and 6. Upon completion of the processing of the step 31, the CPU scans the switches of the control switch circuit 12*a* to detects ON/OFF states thereof at the next step 32, and effects a necessary processing for determining tone color of the tones to be generated by the musical tone generating circuit 14 in accordance with the detected ON/OFF states. At the step 32, the CPU 17 also reads the resistance values of the variable resistors in the control switch circuit 12*a* to determine levels or volumes of the tones to be generated by the musical tone generating circuit 14. At the next step 33, the CPU 17 outputs the various data obtained in the steps 31 and 32 (e.g., the key codes KC, the tone color data TCD and the data KON representative of the key-on signals all assigned to the tone generating channels) to the musical tone generating circuit 14 and the envelope generator 19.

The key-assigning processing effected at the step 31 includes key-on processing and key-off processing which are shown respectively in FIGS. 5 and 6. The key-on processing shown in FIG. 5 is effected when the CPU 17 detects a newly depressed key which should be assigned to a proper one of the tone channels. On the other hand, the key-off processing shown in FIG. 6 is effected when a newly released key is detected.

The key-on processing will now be described with reference to FIG. 5. At step 35, the CPU 17 stores the key code KC representative of the newly depressed key into the key-code register KCODE, resets both of the channel number register KCH and the truncate channel register ACH to "0", and stores the maximum value into the envelope level register EL. A loop $L_1$ including steps 36 to 42 and a return path from the step 42 to the step 36 is provided for detecting the channel to which the smallest one of the envelope level data is applied, that is, the truncate channel. At the step 36, the CPU 17 increments the contents of the channel number register KCH by one to indicate the next tone generating channel with respect to which this key-on processing should be effected. In this case, the contents of the channel number register KCH become "1". At the next step 37, the CPU 17 determines whether the contents of the key-on register KON designated by the channel number in the channel number register KCH (that is, the contents of the key-on register KON(KCH)) is "1". If the determination result at the step 37 is "NO", that is to say, if the key assigned to the channel is in the OFF state, the processing proceeds to the step 38. On the other hand, if the determination result at the step 37 is "YES", that is to say, if the key assigned to the channel is in the "ON" state, the processing proceeds to the step 42. At the step 38, the CPU 17 reads the key code KC contained in the key-code register KCR(KCH) designated by the channel number in the channel number register KCH and reads the weighting data from the address of the weight data ROM 22 accessed in accordance with the read key code KC. The weighting data thus read from the weight data ROM 22 is stored into the weight data register WL. At the next step 39, the CPU 17 reads from the envelope generator 19 the envelope level data EGL designated by the channel number in the channel number register KCH (or the envelope level data EGL(KCH)), and weights the read envelope level data EGL(KCH) with the aforesaid weighting data to form the weighted envelope level data EGL'(KCH). At the next step 40, the CPU 17 determines whether the weighted envelope level data EGL'(KCH) is smaller than the contents of the envelope level register EL. If the determination result at the step 40 is "YES", the processing proceeds to the step 41 wherein the channel number contained in the channel number register KCH is stored in the truncate channel register ACH and at the same time the weighted envelope level data EGL'(KCH) is stored in the envelope level register EL. Then, the processing proceeds to the next step 42. On the other hand, if the determination result at the step 40 is "NO", the processing proceeds to the step 42. At the step 42, the CPU 17 determines whether the channel number contained in the channel number register KCH is the maximum value of "N". If the determination result at the step 42 is "NO", the processing returns to the step step 36. Thus, the processing in the loop $L_1$ is carried out N times. And when the channel number contained in the channel number register KCH reaches "N", the determination result at the step 42 becomes "YES", so that the processing proceeds to step 43. In this case, the truncate channel register ACH contains the channel number of that tone generating channel which corresponds to the smallest one of the weighted envelope level data EGL'.

At the step 43, it is determined whether the contents of the truncate channel register ACH is "0". If the keys assigned to all the tone generating channels are in the ON states, the processing of the step 41 is never carried out, so that the contents of the truncate channel register ACH become equal to "0". In this case, this key-on processing is terminated, and the processing returns to the main routine of FIG. 4. On the other hand, if there is a channel to which the newly depressed key can be assigned, the contents of the truncate channel register ACH contains a value other than "0". Consequently, the determination result at the step 43 becomes "NO", so that the processing proceeds to the next step 44. At this step 44, the key code KC of the newly depressed key contained in the key-code register KCODE is stored into the key-code register KCR(ACH) designated by the channel number held in the truncate channel register ACH. Also, "1" is stored in the key-on register KON(ACH) designated by the channel number contained in the truncate channel register ACH. Then, the processing returns to the main routine of FIG. 4.

The key-off processing will now be described with reference to FIG. 6. At step 45, the CPU 17 stores the key code KC representative of the newly released key into the key-code register KCODE, and resets the channel number register KCH to "0". At the next step 46, the CPU 17 increments the contents of the channel number register KCH by one. At step 47, it is determined whether the key code KC contained in the key-code register KCR(KCH) designated by the channel number held in the channel number register KCH coincides with the key code KC in the key-code register KCODE. If the determination result at the step 47 is "YES", the processing proceeds to the next step 48 at which the key-on register KON(KCH) designated by the channel number contained in the channel number register KCH is reset to "0". Then, the processing proceeds to the next step 49. On the other hand, if the determination result at the step 47 is "NO", the processing proceeds from the step 47 to the step 49. At the step 49, it is determined whether the channel number held in the channel number register KCH is equal to "N". If the determination result at the step 49 is "NO", the processing returns to the step 46. On the other hand, this key-off processing terminates if it is determined at the step 49 that the channel number in the channel number register KCH is equal to "N". According to this key-off processing, "0" is stored in the key-on register KON corresponding to the tone generating channel to which the newly released key is assigned.

Thus, in this embodiment, the envelope level data EGL to the respective tone generating channels are so modified that the lower a tone pitch or a tone range of a newly depressed key, the more gently the corresponding envelope level data decreases. And, the tone generating channel to which the newly depressed key is assigned is selected based on these modified envelope level data EGL'. Thus, an assignment of a newly depressed key to the tone generating channels can be effected such that generation of a tone in the lower tone range is kept over a long decay time and will not forcibly be stopped.

A second embodiment of the invention will now be described.

Figure 7:
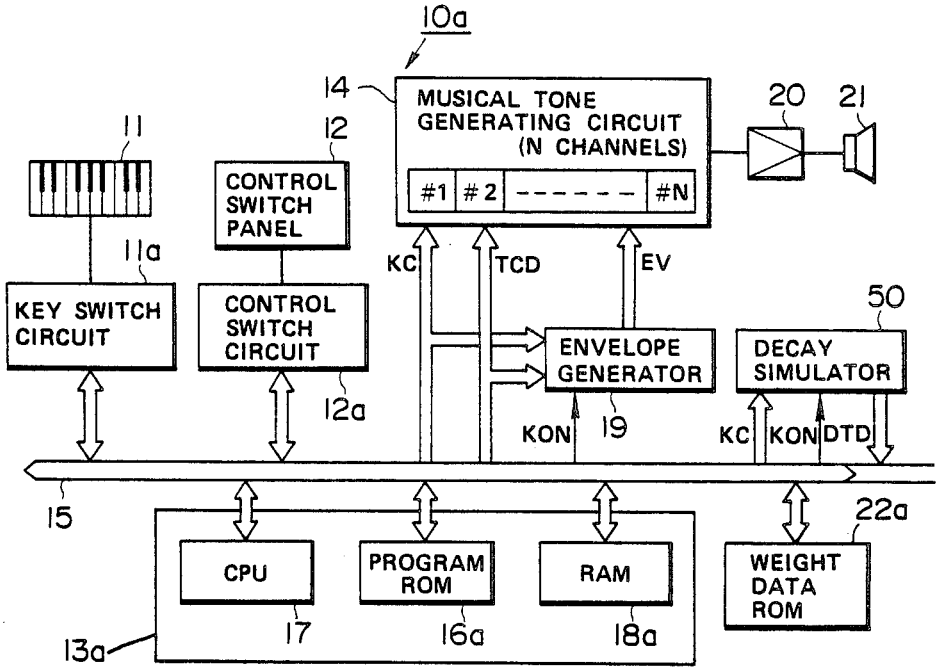
FIG. 7 is a block diagram of an electronic musical instrument 10*a* provided in accordance with a second embodiment of the invention.

FIG. 7 shows a block diagram of an electronic musical instrument 10*a* provided in accordance with the second embodiment of the invention. The aforesaid first embodiment uses the envelope level data EGL to select a truncate channel, that is, the tone generating channel to which a newly depressed key is assigned, whereas this electronic musical instrument 10*a* uses decay time data DTD outputted from a decay simulator 50 to select a truncate channel.

The decay simulator 50 simulates decays of tones generated respectively by the tone generating channels of the musical tone generating circuit 14. The decay simulator 50 comprises, for example, first to Nth accumulators for respectively accumulating decay time control parameters assigned to the first to Nth tone generating channels of the musical tone generating circuit 14, the accumulations being effected by sequential additions or subtractions. For example, each of the accumulators of the decay simulator 50 accumulates the corresponding decay time control parameter at a predetermined time interval from the time when the key-on signal KON of the key assigned to the corresponding tone generating channel changes from "1" to "0". The results of the accumulations of the decay time control parameters are outputted from the respective accumulators as the decay time data DTD. Thus, the more the tone from the tone generating channel decays, the greater the decay time data DTD corresponding to the channel becomes. In this case, the key code KC of the key assigned to the tone generating channel can be uses as the decay time control data DTD therefor. Each key code KC includes in its higher-order bits a block code BC representative of a key range to which the key belongs and includes in its lower-order bits a note code NC representative of a note of the key within the key range. And therefore, if higher order bits of each key code KC are used as the decay time control parameter, the decay time data DTD of a higher pitch key increases at a higher rate than that of a lower pitch key.

To select a truncate channel, each of the decay time data DTD is inverted to produce data $\overline{DTD}$ which decrease with the decay of tone. Each of the thus produced data $\overline{DTD}$ is weighted with the corresponding weighting data read from a weight data ROM 22*a* to form weighted data $\overline{DTD}'$. Then, these weighted data $\overline{DTD}'$ are compared with each other to select a truncate channel.

Figure 8:
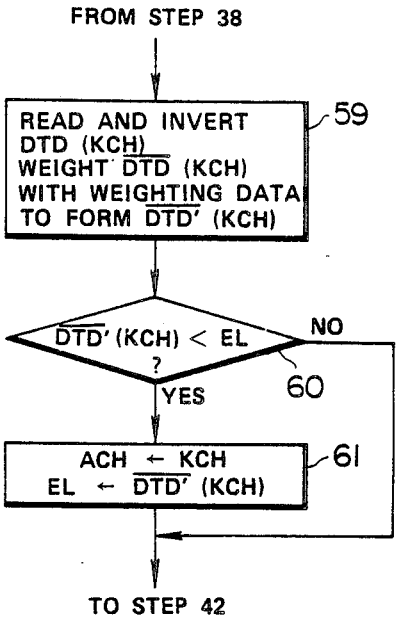
FIG. 8 is a flow chart of part of the key-on processing routine executed by the CPU 17 of FIG. 7.

The above processing can be achieved by modifying the steps 39 to 41 of FIG. 5 into steps 59 to 61 of FIG. 8. In FIG. 8, when the processing of the step 38 is completed, the processing proceeds to the step 59. At the step 59, the CPU 17 reads from the decay simulator 50 the decay time data DTD designated by the channel number in the channel number register KCH (or the decay time data DTD(KCH)), and inverts it. The CPU 17 then weights the inverted decay time data $\overline{DTD}$(KCH) with the weighting data read from the weight data ROM 22*a* to form the weighted decay time data $\overline{DTD}'$(KCH). At the next step 60, the CPU 17 determines whether the weighted decay time data $\overline{DTD}'$(KCH) is smaller than the contents of the envelope level register EL. If the determination result at the step 60 is "YES", the processing proceeds to the step 61 wherein the channel number contained in the channel number register KCH is stored in the truncate channel register ACH and at the same time the weighted decay time data $\overline{DTD}'$(KCH) is stored in the envelope level register EL. Then, the processing proceeds to the next step 42. On the other hand, if the determination result at the step 60 is "NO", the processing proceeds directly to the step 42.

If the decay simulator 50 is so arranged that each decay time control parameter is weighted with the corresponding weighting data before accumulation, the CPU 17 only reads and inverts the decay time data DTD at the step 59. In this case, however, the CPU 17 must weight each of the key codes KC of the keys assigned to the respective channels with corresponding weighting data read from the weight data ROM 22*a*, and output the weighted key codes to the decay simulator 50. The weighting data stored in the weight data ROM 22*a* in this case is of such a kind that the value thereof increases with the increase of tone pitch or tone range.

In this embodiment, the decay time data DTD are formed by the decay simulator 50 as described above. It will be however apparent that formation of such decay time data DTD can alternatively be achieved by the CPU 17.

The above arrangement, in which selection of a truncate channel is achieved by the use of the decay simulator 50, is particularly suitable for the electronic musical instrument 10*a* wherein both of the musical tone generating circuit 14 and the envelope generator 19 are of the analog-circuit type. More specifically, with the above arrangement, the envelope generator 19 need not transfer data representative of the envelope signal EV to the CPU 17, so that the envelope generator 19 can be designed only taking into consideration the relation with the musical tone generating circuit 14.

In this embodiment, when a selection of the tone generating channel to which a newly depressed key is to be assigned is achieved, the newly depressed key is immediately assigned to the selected channel with the abrupt stop of generation of the tone of the key precedingly assigned to the same channel. Alternatively, the assignment of the newly depressed key may be performed after causing the tone of the precedingly assigned key to be rapidly decayed. Also, this embodiment can be easily be modified so that the assignment of newly depressed keys in the aforesaid manner is effected only when specific tone colors such as a piano tone is selected.

A third embodiment of the invention will now be described.

Figure 9:
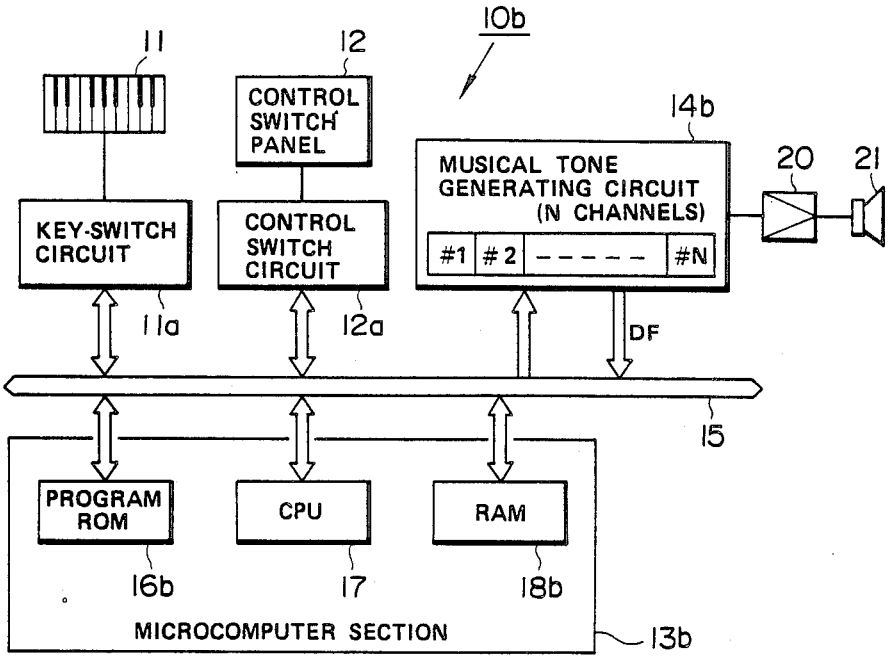
FIG. 9 is a block diagram of an electronic musical instrument 10*b* provided in accordance with a third embodiment of the invention.

FIG. 9 is a block diagram of an electronic musical instrument 10*b* provided in accordance with the third embodiment of the invention. The electronic musical instrument 10*b* differs from the electronic musical instrument of FIG. 7 in the following respects:

A musical tone generating circuit 14*b* has a plurality of tone generating channels of which number is smaller than the number of keys of the keyboard 11. Each of the tone generating channels generates a tone signal having a pitch, a tone color and an envelope which are determined by a key code KC and data representative of the states of the control switches in the control switch circuit 12*a*. Each of the tone generating channels also outputs a tone generation termination signal DF to the CPU 17 through the signal bus 15 when generation of the tone is terminated. If a sustaining-type tone of, for example, a flute, a violin and the like is selected by the control switch panel 12, the tone generating channel generates a tone signal having an envelope which rapidly rises upon depression of a key on the keyboard 11, maintains a constant amplitude during the depression of the key and gradually decays from the release of the key. Then, when the signal level of the tone signal becomes substantially equal to zero, the tone generating channel outputs the tone generation termination signal DF indicative of the termination of generation of the tone and also outputs data DFch representative of that tone generating channel which has just terminated the generation of the tone. On the other hand, if a decaying-type tone of, for example, a piano, a guitar and the like is selected by the control switch panel 12, the tone generating channel generates a tone signal having an envelope which rapidly rises upon depression of a key on the keyboard 11, begins to gradually decay irrespective of release of the key upon reaching a predetermined signal level, continues to gradually decay during the depression of the key, and rapidly decays when the key is released during the gradual decay thereof. Then, when the signal level of the tone signal becomes substantially equal to zero, the tone generating channel outputs the tone generation termination signal DF indicative of the termination of generation of the tone and also outputs data DFch representative of that tone generating channel which has just terminated the generation of the tone. The musical tone generating circuit 14*b* is also so constructed that time constants for determining the shape of attack and decay portions of an envelope for a lower pitch tone are greater than those for a higher pitch tone. And therefore, a decay time of a lower pitch tone is longer than that of a higher pitch tone, as is the case with piano tones. The number N of the tone generating channels may be set to any number from several to more than ten.

A microcomputer section 13*b* is similar in construction to the microcomputer section 13*a* of FIG. 7 but is responsive to the tone generation termination signal DF for executing an interrupt routine, which will be described later, to thereby process data stored in a RAM 18*b* for terminating generation of the tone.

Figure 10:
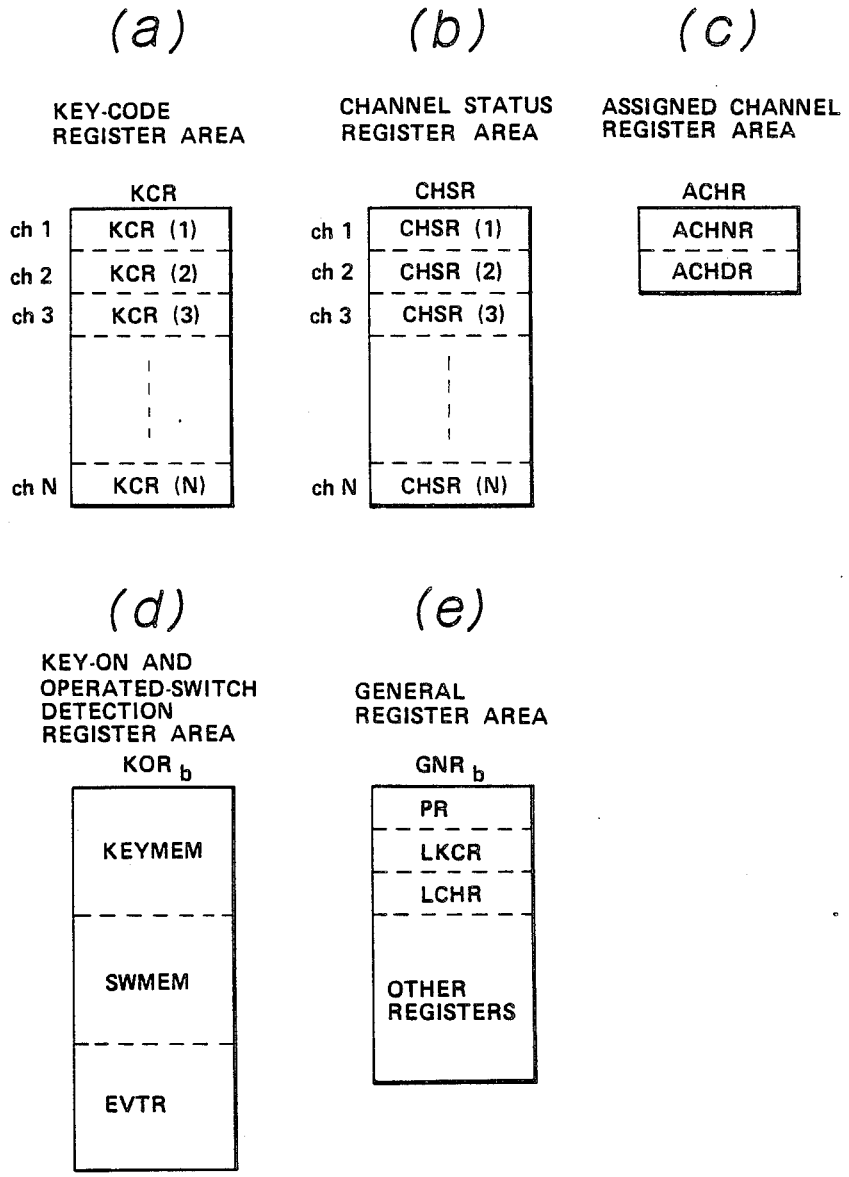
FIGS. 10(*a*)–(*e*) are illustrations showing various register areas provided in the RAM 18*b* of FIG. 9.

As shown in FIG. 10, the RAM 18*b* of FIG. 9 is mapped to include, in addition to the key-code register area KCR (FIG. 10-(*a*)), a channel status register area CHSR for storing operating states of the tone generating channels of the musical tone generating circuit 14*b* (FIG. 10-(*b*)), and an assigned channel register area ACHR for storing assigned channel data for designating the channel (or the truncate channel) to which a key newly depressed on the keyboard 11 is to be assigned (FIG. 10-(*c*)). The RAM 18*b* further comprises a key-on and operated-switch detection register area KORb (FIG. 10-(*d*)) used to detect key depressions and operations of the control switches, and general register area GNRb (FIG. 10-(*e*)) used to effect a calculation of channel assignment and other calculations.

Each key code KC representative of the corresponding key increases with the increase of pitch of the key, but do not take a value which is composed of bits all in the state of "1".

The channel status register area CHSR shown in FIG. 10-(*b*) comprises first to Nth channel status registers CHSR(1) to CHSR(N) corresponding respectively to the first to Nth tone generating channels of the musical tone generating circuit 14*b*, each of which stores channel status data representative of a state of that key which is assigned to its corresponding tone generating channel. The channel status data indicates that the assigned key is in the ON state when the MSB thereof is "0", and indicates that the assigned key is in the OFF state when the MSB is "1". The remaining lower bits of the channel status data represent the lapse of time from depression or release of the assigned key, and the value thereof increases with the increase of such lapse of time.

The assigned channel register area ACHR shown in FIG. 10-(*c*) comprises an assigned channel number register ACHNR for storing assigned channel number data ACHN which represents the channel number of that channel to which a newly depressed key is assigned (or the truncate channel). The assigned channel register area ACHR also comprises an assigned channel status register ACHDR for storing assigned channel status data ACHD relating to that channel indicated by the assigned channel number data ACHN.

The key-on and operated switch detection register area KORb shown in FIG. 10-(*d*) comprises a key status memory KEYMEM composed of a plurality of bits equal in number to the keys of the keyboard 11 each for storing data of "1" or "0" respectively representing depression and release of a respective one of the keys. The key-on and operated-switch detection register area KORb also comprises a control-switch status memory SWMEM composed of a plurality of storage positions equal in number to the control switches and the variable resistors each for storing an ON/OFF state or resistance value of a respective one of the control switches and the variable resistors. The key-on and operated-switch detection register area KORb further comprises an event data register section EVTR having a plurality of registers for storing key-on event data representative of key-on events on the keyboard 11 and control-switch event data representative of events relating to operation of the control switch levers on the control switch panel 12.

The general register area GNR shown in FIG. 10-(*e*) comprises a pointer register PR used as a pointer for sequentially renewing the channel number during the time when a lowest-pitch tone search routine or a channel search routine, which will be described later, is executed. The general register area GNRb also comprises a lowest-pitch tone register LKCR for storing the key code KC of the lowest-pitch one of those keys assigned to the channels which are generating decaying tones. The general register area GNRb further comprises a lowest-pitch tone channel register LCHR for storing lowest-pitch tone channel number data indicative of that tone generating channel which is generating the above-described lowest-pitch tone, and other registers for storing variables or the like necessary for the calculation effected by the microcomputer section 13*b*.

The operation of the electronic musical instrument 10*b* will now be described with reference to flow charts shown in FIGS. 11 to 15.

Figure 11:
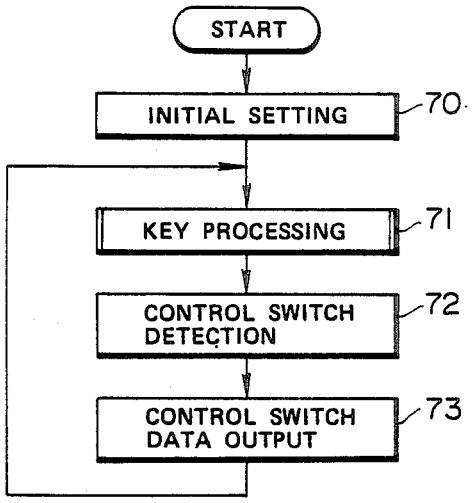
FIG. 11 is a flow chart of the main routine executed by the CPU 17 of FIG. 9.

When power is supplied to the electronic musical instrument 10*b*, the CPU 17 starts to execute a main routine shown in FIG. 11. The CPU 17 effects an initial setting processing at step 70 for initializing the RAM 18*b*. At this step 70, all of bits of the key status memory KEYMEM, event data register section EVTR, pointer register PR, lowest-pitch tone channel register LCHR and the other registers are reset to "0". On the other hand, all of bits of the first to Nth key-code registers KCR(1) to KCR(N), first to Nth channel status registers CHSR(1) to CHSR(N), assigned channel status register ACHDR and lowest-pitch tone register LKCR are rendered "1". Also, the contents of the assigned channel number register ACHNR are rendered "1". The CPU 17 further writes data representative of operation states of the control switch levers and variable resistors of the control switch panel 12 in accordance with control switch status signals fed from the control switch circuit 12*a*. These data are also supplied to the musical tone generating circuit 14*b* to determine the tone color and tone levels of the tone to be generated thereby.

Figure 12:
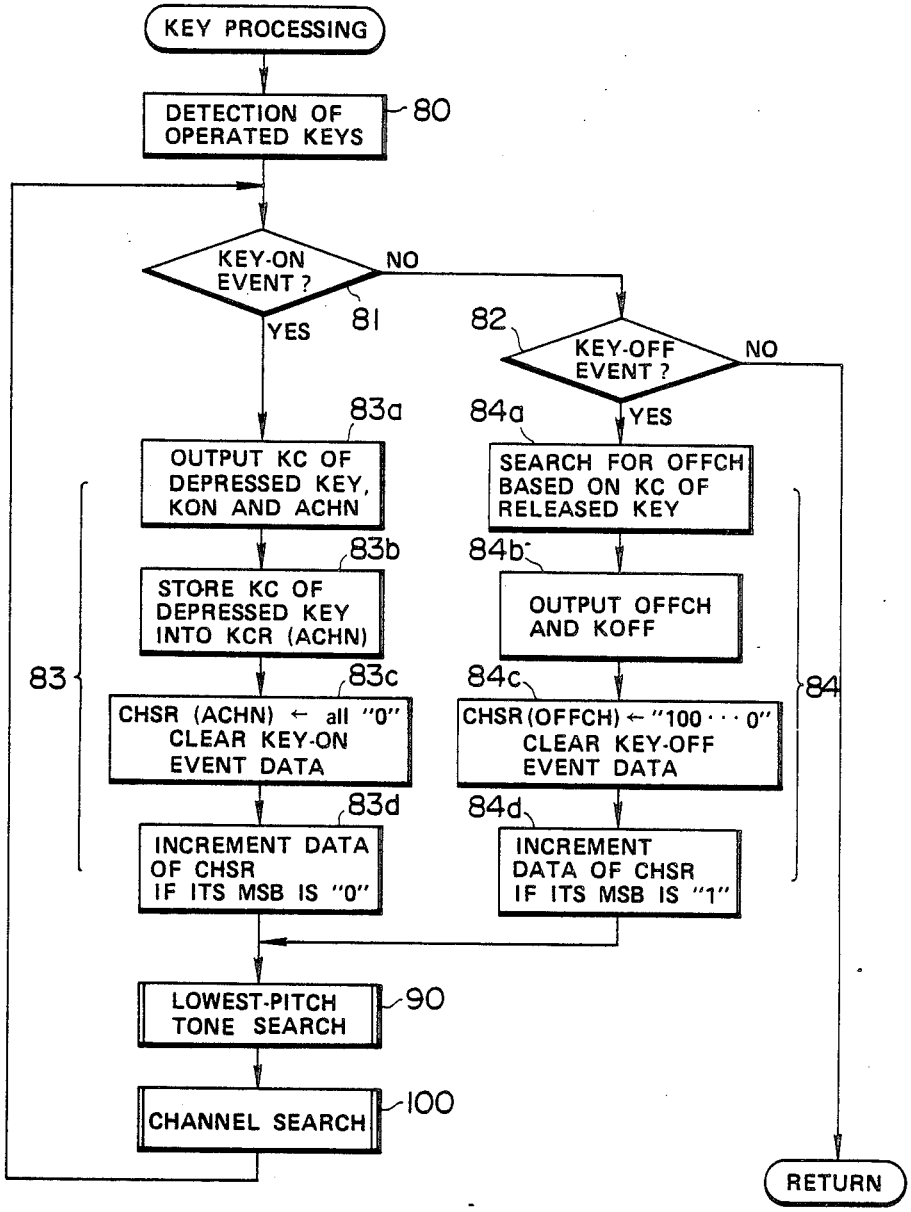
FIG. 12 is a flow chart of the key processing routine executed at the step 71 of FIG. 11.
Figure 14:
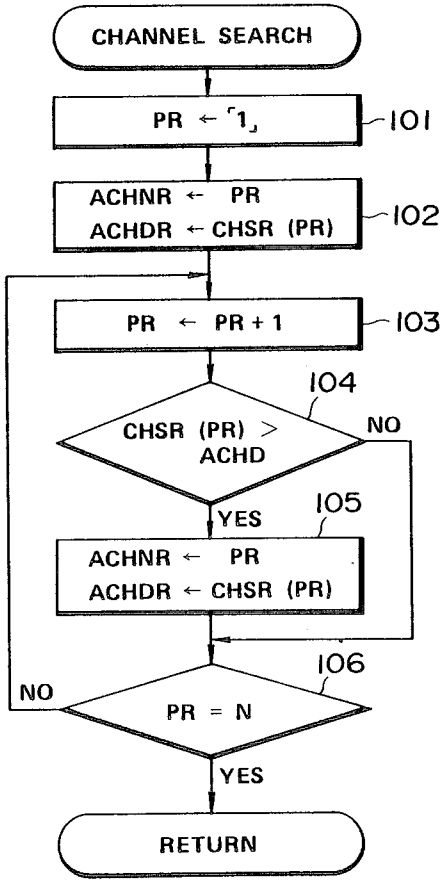
FIG. 14 is a flow chart of the channel search routine executed at the step 100 of FIG. 12.
Figure 13:
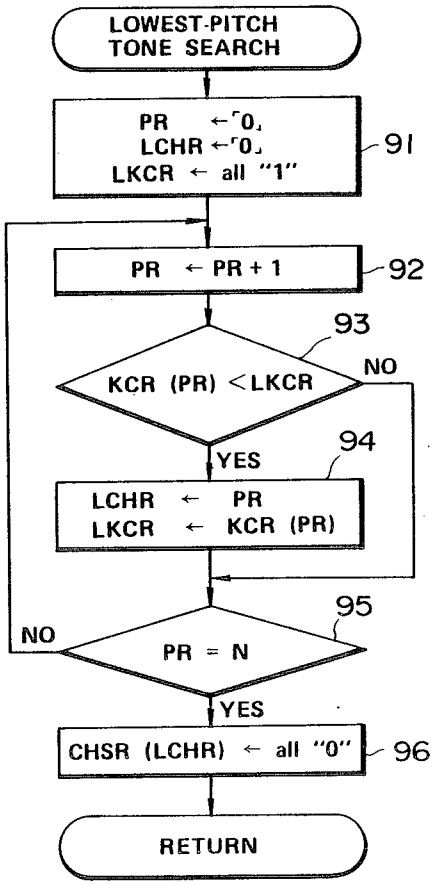
FIG. 13 is a flow chart of the lower-pitch tone search routine executed at the step 90 of FIG. 12.

Upon completion of the initial setting processing described above, the CPU 17 executes a key processing routine at the next step 71. At this step 71, the CPU 17 executes respective routines whose flow charts are shown in FIGS. 12 to 14 to thereby control the generation of tones in accordance with depression and release of keys on the keyboard 11.

At the next step 72, the CPU 17 detects the states of the control switch levers of the control switch panel 12, and then outputs the detection results to the musical tone generating circuit 14*b*, at step 73, to thereby control the tone color and the tone levels of the tones generated. At the step 72, the CPU 17 reads the states of the control switches in the control switch circuit 12*a* and the resistance values of the variable resistors in the control switch circuit 12*a* as new control switch data. The CPU 17 then compares each of the new control switch data with a respective one of those control switch data which have already been stored in the control switch status memory SWMEM. If there is any difference between the two data, then it is determined that the control switch lever or the variable resistor corresponding to these two data is operated, and the new control switch data corresponding to this control switch lever or the variable resistor is stored in the corresponding storage position of the control switch status memory SWMEM. At the same time, the new control switch data is written into a register in the event data register section EVTR as a control switch event data. At the step 73, the CPU 17 determines whether there is any control switch event data in the event data register section EVTR, and if it is determined that there is one, the CPU 17 outputs the control switch event data and at the same time clears it from the event data register section EVTR. The above operation is repeatedly carried out until all of the control switch event data are cleared from the event data register section EVTR. When it is determined at the step 72 that all of the new control switch data coincide respectively with those already stored, the rewriting and output of the control switch data are not effected.

Upon completion of the steps 73, the CPU 17 returns the processing to the step 71. Thus, the CPU 17 repeatedly carries out the steps 71 to 73 to control the generation of tones by the musical tone generating circuit 14*b* in accordance with the operation of the keyboard 11 and the control switch panel 12.

The key processing routine executed by the CPU 17 at the step 71 will now be more fully described with reference to the flow chart shown in FIG. 12.

At step 80, the CPU 17 detects depression and release of keys on the keyboard 11. In this case, the CPU 17 scans all the key switches from the highest-pitch tone side to the lowest-pitch tone side to sense the ON/OFF states to the key switches as new key-status data. The CPU 17 then compares each of the new key-status data with a respective one of those stored in the key status memory KEYMEM to thereby detect changes of ON/-OFF states of the keys. More specifically, when the new key-status data is "1" and when the corresponding key-status data stored in the key status memory KEYMEM (i.e., the corresponding old key-status data) is "0", the CPU 17 determines that the corresponding key is newly depressed on the keyboard 11. In this case, the CPU 17 stores the new key-status data of "1" into that storage position of the key status memory KEYMEM which corresponds to the newly depressed key, and also stores, as a key-on event data, the key code KC representative of the newly depressed key and an identification data, indicating that the key is newly depressed, into a register in the event data register section EVTR. When the new key-status data is "0" and when the corresponding old key-status data is "1", the CPU 17 determines that the corresponding key is newly released on the keyboard 11. In this case, the CPU 17 stores the new keystatus data of "0" into that storage position of the key status memory KEYMEM which corresponds to the newly released key, and also stores, as a key-off event data, a key code KC representative of the newly released key and an identification data, indicating that the key is newly released, into a register in the event data register section EVTR. The key codes KC may be formed from the contents of a scanning counter (not shown) which sequentially addresses the key switches corresponding respectively to the keys during the scanning thereof. According to the above-described scanning of the key switches, when the detection of all the states of the keys is completed, all the key-on and key-off event data corresponding to those keys whose ON/-OFF states have changed during the period between the preceding execution of the step 80 and the present execution thereof are stored in the event data register section EVTR.

The processing then proceeds to the next step 81 at which the CPU 17 determines whether there is any key-on event data in the event data register section EVTR. If the determination result is "NO", the CPU 17 further determines, at step 82, whether there is any key-off event data in the event data register section EVTR. When there has been no change of states of the keys on the keyboard 11, the results of the above two determinations are both "NO", so that this key processing routine is terminated, and the processing proceeds from the step 82 to the step 72 of FIG. 11.

When a key has been depressed on the keyboard 11, the CPU 17 detects the presence of its key-on event data stored in the event data register section EVTR at the step 81, so that the determination result at the step 81 becomes "YES". Consequently, the processing proceeds to step 83*a*, at which the CPU 17 outputs, to the musical tone generating circuit 14*b*, key-on key data composed of the key code KC contained in that of the key-on event data which is read from the event data register section EVTR, the key-on data KON indicating that this key code KC is of a depressed key and the assigned channel number data ACHN ("1" in the initial condition) stored in the assigned channel number register ACHNR. As a result, the tone generating channel designated by the assigned channel number data ACHN begins to generate a tone signal of a pitch determined by the key code KC. In this case, if the designated tone generating channel has already been generating another tone signal, the generation of this another tone signal is stopped, and the tone signal of the pitch designated by the key code KC of the newly depressed key begins to be generated. When the above change of generation of tone signal from the another musical tone signal to the newly designated musical tone signal, a click noise may be generated. To avoid this, it is desirable that the aforesaid another tone signal be quickly reduced before beginning the generation of the musical tone of the newly depressed key. The processing then proceeds from the step 83*a* to step 83*b* at which the CPU 17 stores the outputted key code KC into the key code register KCR(ACHN) designated by the assigned channel number data ACHN. Then, at the next step 83*c*, the CPU 17 resets all the bits of the channel status register CHSR(ACHN) designated by the assigned channel number data ACHN to "0", and also clears the key-on event data thus processed from the event data register section EVTR. The reset of the bits of the channel status register CHSR(ACHN) and the clear of the corresponding key-on event data is the initialization of this channel status register. Upon completion of the processing of the step 83*c*, the CPU 17 adds "1" to all data contained in those of the first to Nth channel status registers CHSR(1) to CHSR(N) of which MSBs are "0". Thus, the later the key is depressed, the smaller data the channel status register corresponding to the depressed key contains. The above four steps 83*a* to 83*d* constitute a key-on event processing routine 83. When the processing of the key-on event processing routine 83 is completed, the CPU 17 executes at the next step 90 a lowest-pitch tone search routine to detect the tone generating channel which corresponds to that of the currently generated musical tones which has the lowest pitch. At the next step 100, the CPU 17 executes a channel search routine to store, into the assigned channel number register ACHNR, assigned channel number data ACHN indicative of the tone generating channel to which a key which will be depressed next is to be assigned. The lowest-pitch tone search and channel search routines will be more fully described later. Then, the processing returns from the step 100 to the step 81. At the step 81, the CPU 17 again detects the presence of key-on event data in the event data register section EVTR as described above, and if any key-on event data are detected, the CPU 17 executes the key-on event processing routine 83 to output key-on key data and also carries out the processing of the steps 90 and 100. Thus, each time the processing in a loop composed of the steps 81, 83*a* to 83*d*, 90 and 100 is carried out, that of the key-on event data corresponding to the outputted key-on key data is cleared from the event data register section EVTR, so that all the key-on key data of the newly depressed keys are outputted to the musical tone generating circuit 14*b*.

On the other hand, when a key or keys has been released on the keyboard 11 and when all the key-on key data have been outputted or there has been no new depression of keys, the result of the determination at the step 81 becomes "NO" since there is no key-on event data in the event data register section EVTR, whereas the result of the determination at the step 82 becomes "YES" since there are key-off event data in the event data register EVTR. As a result, the processing proceeds to step 84*a* of a key-off event processing routine 84. At this step 84*a*, the CPU 17 detects that of the key-code registers KCR(1) to KCR(N) which contains the same key code KC as that included in one of the key-off event data which is just read from the event data register section EVTR. The CPU 17 then detects the channel number of that tone generating channel which corresponds to the detected key-code register as key-off channel number data OFFCH. At the next step 84*b*, the CPU 17 outputs, to the musical tone generating circuit 14*b*, key-off key data which is composed of the above key-off channel number data OFFCH and key-off data KOFF indicating that the relevant key is released. The musical tone generating circuit 14*b* causes, in response to the key-off data KOFF, that tone generating channel which is designated by the key-off channel number data OFFCH to decrease the tone signal generated by itself at a rate determined by the tone color and key code KC assigned thereto. The processing then proceeds to the next step 84c at which the CPU 17 sets the MSB of the channel status register CHSR(OFFCH) designated by the key-off channel number data OFFCH to "1" and resets the remaining bits of the same channel status register CHSR(OFFCH) to "0". The CPU 17 also clears the key-off event data thus processed from the event data register section EVTR. At the next step 84d, the CPU 17 adds "1" to all data contained in those of the channel status registers CHSR(1) to CHSR(N) of which MSBs are "1". Thus, the later the key is released, the smaller data the channel status register corresponding to the released key contains. When the processing of the key-off event processing routine 84 is completed, the processing returns to the step 81 through the steps 90 and 100. So long as there is any key-off event data in the event data register section EVTR, the CPU 17 executes the programs defined by the steps 81, 82, 84a to 84d, 90 and 100 to carry out the key-off event processing. When all of the key-off event data have been processed, this key processing routine is terminated and the processing returns to the step 72 of FIG. 11.

The lowest-pitch tone search routine executed at the step 90 will now be more fully described with reference to the flow chart shown in FIG. 13.

This lowest-pitch tone search routine is provided for detecting the tone generating channel which is generating one of the currently generated tone signals which has the lowest pitch. When the processing of the lowest-pitch tone search routine is started, the CPU 17 effects, at step 91, an initialization of those registers of the general register area GNR which are used in this routine. More specifically, both of the pointer register PR and the lowest-pitch tone channel register LCHR are reset to "0", and all the bits of the lowest-pitch tone register LKCR are set to "1". At the next step 92, the CPU 17 adds "1" to data contained in the pointer register PR to render the data "1". Then, the CPU 17 determines, at the next step 93, whether the data in the lowest-pitch tone register LKCR is greater than the key code KC contained in the key-code register KCR(PR) designated by the data in the pointer register PR. In this case, the data in the pointer register PR is "1", so that the data in the lowest-pitch tone register LKCR is compared with the key code KC contained in the key-code register KCR(1) which corresponds to the first tone generating channel. When the first tone generating channel is generating a tone signal, the key-code register KCR(1) contains therein the key code representative of the generated tone signal, and the key code KC never takes the value whose bits are all "1". And therefore, the result of the determination effected at this step 93 is "YES" in this case, so that the processing proceeds to the next step 94. At the step 94, the data in the lowest-pitch tone channel register LCHR is replaced by the data in the pointer register PR, i.e., the data of "1". Also, the data in the lowest-pitch tone register LKCR is replaced by the key code KC in the key-code register KCR(1), and the processing proceeds to the next step 95. On the other hand, if the first tone generating channel is not generating a tone signal, the key-code register KCR(1) contains data whose bits are all "1" as a result of the initial setting processing at the step 70 of FIG. 11 or processing effected by a DF interrupt routine which will be described later. And therefore, the result of the determination effected by the CPU 17 at the step 93 is "NO", so that the processing proceeds directly to the step 95. At the step 95, the CPU determines whether the data in the pointer register PR is equal to "N". In this case, the data in the pointer register PR is "1", so the determination result is "NO". Consequently, the processing returns to the step 92, whereupon "1" is added to the data contained in the pointer register PR to cause it to become "2". Then, the processing of the steps 93 to 95 is again carried out. The processing in a loop composed of the steps 92 to 95 is repeatedly carried out until the data in the pointer register PR becomes equal to "N". When the data in the pointer register PR reaches "N", the determination result at the step 95 becomes "YES", so that the processing proceeds to the next step 96. As a result of N times of executions of the processing in the aforesaid loop, the data in the lowest-pitch tone register LKCR is rendered equal to the smallest one of the key codes KC stored in the first to Nth key-code registers KCR(1) to KCR(N), that is, the key code KC of the lowest-pitch tone. Also, the data in the lowest-pitch tone channel register LCHR is rendered equal to the channel number of that key-code register which stores the key code KC representative of the lowest-pitch tone. At the step 96, the CPU 17 stores data whose bits are all "0" into the channel status register CHSR(LCHR) designated by the lowest-pitch tone channel number stored in the lowest-pitch tone channel register LCHR. Then, the processing of this lowest-pitch tone search routine is terminated.

The channel search routine executed at the step 100 will now be more fully described with reference to the flow chart shown in FIG. 14.

This channel search routine is provided for determining the tone generating channel to which the newly depressed key is to be assigned, that is, the truncate channel. When the processing of the channel search routine is started, the CPU 17 stores data of "1" into the pointer register PR at step 101. At the next step 102, the CPU 17 stores the data contained in the pointer register PR into the assigned channel number register ACHNR, and also stores the data contained in the channel status register CHSR(PR) designated by the contents of the pointer register PR into the assigned channel status register ACHDR. In this case, the data in the pointer register PR is "1", so that the data of "1" is stored into the assigned channel number register ACHNR and that the data contained in the first channel status register CHSR(1) is stored into the assigned channel status register ACHDR. The processing then proceeds to the next step 103, at which the CPU 17 adds "1" to the data in the pointer register PR to render the data "2". At the next step 104, the data in the channel status register CHSR(PR) designated by the contents of the pointer register PR is compared with the assigned channel status data ACHD stored in the assigned channel status register ACHDR. In this case, the contents of the pointer register PR are "2", so that the data in the second channel status register CHSR(2) is compared with the assigned channel status data ACHD. When the data in the channel status register CHSR(2) is greater than the assigned channel status data ACHD, the determination result at the step 104 becomes "YES", so that the processing proceeds to the next step 105. At this step 105, the data in the pointer register PR is stored into the assigned channel number register ACHNR, and the data in the channel status register CHSR(PR) designated by the data in the pointer register PR is stored into the assigned channel status register ACHDR. In this case, the data in the pointer register PR is "2", so that "2" is stored into the assigned channel number register ACHNR and that the data in the second channel status register CHSR(2) is stored into the assigned channel status register ACHDR. The processing then proceeds to the next step 106. On the other hand, if the data in the channel status register CHSR(2) is equal to or smaller than the assigned channel status data ACHD, the determination result at the step 104 becomes "NO", so that the processing proceeds from this step 104 directly to the step 106. At the step 106, the CPU 17 determines whether the data in the pointer register PR is equal to "N". In this case, the data in the pointer register PR is "2", so that the determination result at the step 106 is "NO". Consequently, the processing returns to the step 103, whereupon "1" is again added to the contents of the pointer register PR to render the data "3". Then, the processing of the steps 104 to 106 is again carried out.

The processing in a loop composed of the steps 103 to 106 is repeatedly carried out until the data in the pointer register PR becomes equal to "N" as a result of the sequential increment of the data by "1". When the data in the pointer register PR reaches "N", the result of the determination effected at the step 106 becomes "YES", so that the processing of this channel search routine is terminated. As a result of (N−1) times of executions of the processing in the aforesaid loop, the assigned channel status register ACHDR stores the largest one of the data contained in the first to Nth channel status registers CHSR(1) to CHSR(N), also the assigned channel number register ACHNR stores the data representative of the channel number of the channel status register in which the largest data is stored. In this case, each of the first to Nth channel status registers CHSR(1) to CHSR(N) stores:

(1) data whose bits are all "1", if the corresponding tone generating channel is not generating a tone signal;

(2) data whose MSB and remaining bits respectively represent "1" and a value which increases with the lapse of time from the release of the corresponding key, if the corresponding tone generating channel is generating a decaying tone signal;

(3) data whose MSB and remaining bits respectively represent "0" and a value which increases with the lapse of time from the depression of the corresponding key, if the corresponding tone generating channel is generating a tone signal of the key which is being depressed; or (4) data whose bits are all "0", if the corresponding tone generating channel is generating the tone signal whose pitch is the lowest of the currently generated tone signals.

As will be appreciated from the above fact, the assigned channel number ACHN in the assigned channel number register ACHNR represents:

(a) the smallest one of the channel numbers of those tone generating channels which are presently generating no tone signals, if there is one or more tone generating channels which are generating no tones;

(b) the channel number of that channel which is generating the tone of the earliest released key, if all of the channels are generating tones and if there are one or more channels which are generating tones of released keys except for the key corresponding to the lowest-pitch tone presently generated;

(c) the channel number of that channel which is generating the tone of the earliest depressed key, if all of the channels are generating tones and if all of the channels except for the channel generating the lowest-pitch tone are generating tones of keys which are presently depressed.

The operation of each tone generating channel performed at the time when the generation of tone signal is terminated will now be described.

When any one of the tone generating channels terminates the generation of tone signal, the musical tone generating channel outputs the tone generation termination signal DF and the tone generation termination channel data DFch to the microcomputer section **13*b*. When the tone generation termination signal DF and the tone generation termination channel data DFch are received by the microcomputer section 13*b*, the CPU 17 interrupts the execution of the main routine shown in FIG. 11 in response to the tone generation termination signal DF and, instead of this, begins to executes the DF interrupt routine shown in FIG. 15**.

At step 110, the CPU 17 renders all the bits of the channel status register CHSR(DFch) designated by the tone generation termination channel data DFch "1". At the next step 111, the CPU 17 also renders all the bits of the key-code register KCR(DFch) designated by the tone generation termination channel data DFch "1". The above two processings are performed in order to initialize the channel status register and the key-code register both corresponding to the tone generating channel which has just terminated the generation of tone signal. Upon completion of the processing of the step 111, the CPU 17 executes the lowest-pitch tone search routine shown in FIG. 13 at step 112, and then executes the channel search routine shown in FIG. 14 at step 113. When the processing of the step 113 is completed, this DF interrupt routine is terminated, and the execution of the main routine resumes. The processing at the steps 112 and 113 is performed since the contents of the channel status registers CHSR(1) to CHSR(N) and of the key-code registers KCR(1) to KCR(N) are changed by the processing of the steps 110 and 111, and the renewal of the lowest-pitch tone and the channel to which the new key is to be assigned must be effected with these new contents.

With the above arrangement, when a key or keys is depressed on the keyboard 11, the key-on event processing routine 83 (FIG. 12) is executed in accordance with the key-on event data to renew the data in the key-code registers KCR(1) to KCR(N) and the channel status registers CHSR(1) to CHSR(N). When a key or keys is released on the keyboard 11, the key-off event processing routine 84 (FIG. 12) is executed in accordance with the key-off event data to renew the data in the key-code registers and the channel status registers. And when the generation of tone signal is terminated at any one of the tone generating channels of the musical tone generating circuit **14*b*, the DF interrupt routine composed of the steps 110 to 113 is executed in response to the termination of the tone generation to renew the contents of the key-code registers and the channel status registers. Then, the lowest-pitch tone search routine composed of the steps 91 to 96 is executed in accordance with the key codes KC stored in the key-code registers to detect the channel which is generating the lowest-pitch tone, and at the same time the channel search routine composed of the steps 101 to 106 is executed to detect one of those channels currently generating tones except for that channel which is generating the lowest-pitch tone, as the channel to which a new key is to be assigned. And, when a key is newly depressed on the keyboard 11**, the key is assigned to the detected channel. Therefore, with this embodiment, the tone in the lower-pitch tone range will not forcibly be stopped even when depression of keys is performed in a quick manner as is the case with a piano. Thus, it is possible to generate a plurality of tones in the higher-pitch tone range one after another at short time intervals while keeping the tone in the lower-pitch tone range sounded over a long period.

First to fifth modified forms of the above third embodiment will now be described.

First Modified Form

The aforesaid electronic musical instrument **10*b* is so constructed that only the channel which is generating the lowest-pitch tone is prevented from being assigned a newly depressed key. The instrument 10*b* may, of course, be modified so that those channels which are generating the lowest two or three of the currently generated tones are prevented from being assigned newly depressed keys. This can be achieved by modifying the lowest-pitch tone search routine of FIG. 13 so that after the lowest-pitch tone is detected by the processing of the steps 91 to 96**, the same processing is performed once or twice more with respect to keys except for the detected lowest-pitch key.

The electronic musical instrument **10*b* can also be modified so that the channels generating those tones which are within a predetermined width (for example, one octave) of tone range whose lower end is the generated lowest-pitch tone are prevented from being assigned newly depressed keys. This can be achieved by modifying the lowest-pitch tone search routine of FIG. 13 as follows. When the lowest-pitch tone is detected by the processing of the steps 91 to 96**, a predetermined value is added to the key code KC of the detected lowest-pitch tone. Then, those keys having key codes KC smaller than the addition result are detected, and data whose bits are all "0" are stored in those channel status registers CHSR which correspond to the detected keys.

Second Modified Form

With the electronic musical instrument **10*b*, when all the tone generating channels are generating tones and any of them are generating decaying tones, a newly depressed key is assigned at the highest priority to the channel which is generating the decaying tone of the earliest released key as taught by Japanese Patent Application Publication No. 59-22238. However, the electronic musical instrument 10*b* may be modified so that a newly depressed key is assigned at the highest priority to the channel which is generating the decaying tone of the smallest envelope level, as taught by Japanese Patent Application Laid-Open No. 52-25613. To achieve this, the CPU 17 reads the envelope level data from those channels which are generating tones other than the lowest-pitch tone currently generated when a key is newly depressed, and detects the channel number of the channel corresponding to the smallest one of the read envelope levels as the assigned channel number data ACHN. Then, the CPU 17** assigns the newly depressed key to the channel designated by the data ACHN.

Third Modified Form

With the electronic musical instrument **10*b*, when a key is newly depressed on the keyboard 11 during the time when all the tone generating channels are generating tones of the keys presently depressed, the newly depressed key is assigned at the highest priority to the channel generating the tone of the earliest depressed one of the presently depressed keys except for the depressed key of the lowest-pitch tone. The electronic musical instrument 10*b*** may be modified so that assignment of the newly depressed key is not effected if all of the channels are presently generating tones. This can be achieved by modifying the programs so that assignment of the newly depressed key is inhibited if all of the MSBs of the first to Nth channel status registers CHSR(1) to CHSR(N) are "0".

Fourth Modified Form

With the structure of the electronic musical instrument **10*b*, the channel which is generating the lowest-pitch note is prevented from being assigned a newly depressed key. The instrument 10*b* may be modified so that the channel generating the highest-pitch tone is prevented from being assigned a newly depressed key. In this case, the lowest-pitch tone search routine executed at the steps 90 and 112 must be replaced by a highest-pitch tone search routine wherein each key code KC takes a value which increases with the decrease of tone pitch of the corresponding key. The aforesaid first to third modifications can still be applied to this fourth modified form of the electronic musical instrument 10*b***.

This fourth modified form can also be combined with the third embodiment so that both of the channels which are generating the lowest-pitch and the highest-pitch tones are prevented from being assigned a newly depressed key.

Fifth Modified Form

With the structure of the electronic musical instrument **10*b*, the channel which is generating the lowest-pitch tone is always prevented from being assigned a newly depressed key. The instrument 10*b* may be modified so that such prevention of assignment of the newly depressed key can be selectively effected in accordance with performer's operation of a specific switch. In this case, the processing of the steps 90 and 112 is effected only when the switch is closed to enable the prevention of assignment. On the other hand, when the switch is opened to disable the prevention of assignment, the steps 90 and 112** are skipped.

Such selection of the prevention of assignment can also be effected in accordance with the selection of tone color via the control switch panel 12. For example, the programs are modified so that the processing of the steps 90 and 112 is effected when specific tone colors such as a piano tone is selected and that the steps 90 and 112 are skipped when other tone colors are selected.

When the prevention of assignment is disabled, the newly depressed key is assigned to the tone generating channels under the same conditions as those shown in Japanese Patent Application Laid-Open No. 52-25613 and Japanese Patent Application Publication No. 59-22238.

A fourth embodiment of the present invention will now be described.

Figure 16:
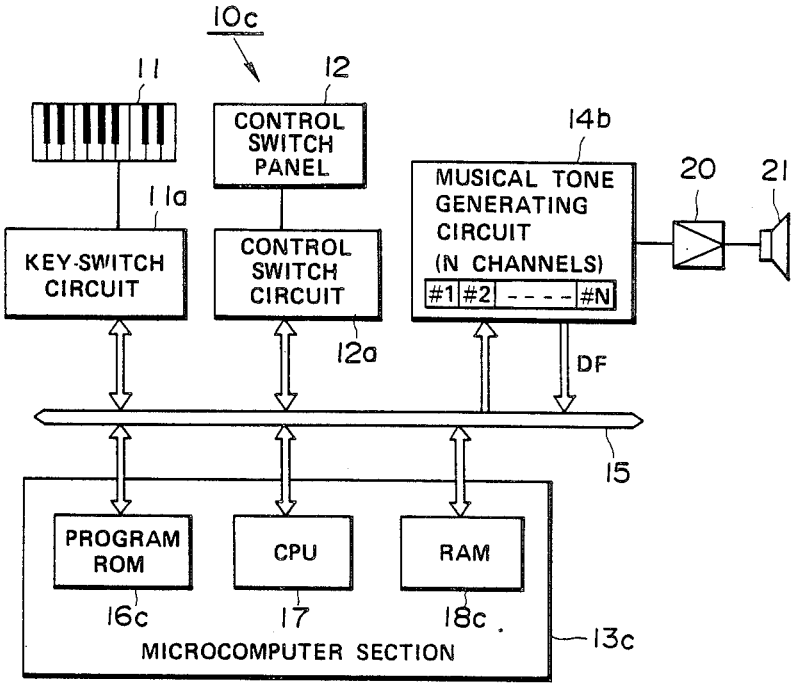
FIG. 16 is a block diagram of an electronic musical instrument 10*c* provided in accordance with a fourth embodiment of the invention.

FIG. 16 is a block diagram of an electronic musical instrument **10*c* provided in accordance with the fourth embodiment of the invention. This electronic musical instrument 10*c* differs from the electronic musical instrument 10*b* of FIG. 9 only in that a program ROM 16*c* stores therein program different from those stored in the program ROM 16*b* of the electronic musical instrument 10*b* and that a RAM 18*c* provides registers different from those provided by the RAM 18*b* of the electronic musical instrument 10*b***.

Figure 17:
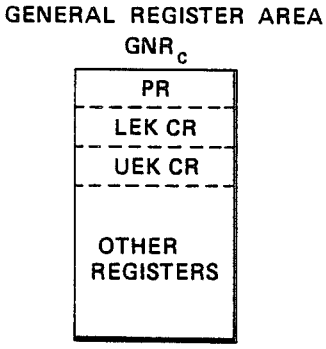
FIG. 17 is an illustration showing the general register GNRc provided in the RAM 18*c* of FIG. 16.

The RAM **18*c* comprises a general register area GNRc shown in FIG. 17 in addition to the key-code register area KCR, channel status register area CHSR, assigned channel register area ACHR and key-on and operated-switch detection register area KORb all shown in FIG. 10. The general register area GNRc comprises a pointer register PR used as a pointer for sequentially renewing the channel number during the time when a lower-pitch tone range channel search routine, which will be described later, or the channel search routine of FIG. 14 is executed. The general register area GNRc also comprises a lower-end key code register LEKCR for storing a lower-end key code LEKC representative of the lower-end tone of a tone range covering those keys whose decaying tones need be kept sounded as long as possible, an upper-end key code register UEKCR for storing an upper-end key code UEKC representative of the upper-end tone of the same tone range and other registers for storing variables or the like necessary for the calculation effected by the microcomputer section 13***c*.

The operation of the electronic musical instrument 10*c* will now be described.

Figure 18:
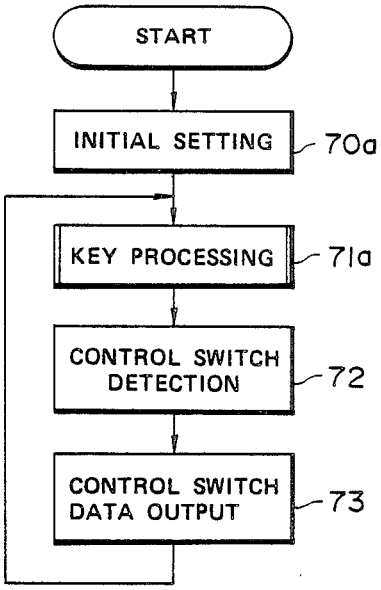
FIG. 18 is a flow chart of the main routine executed by the CPU 17 of FIG. 16.

When power is supplied to the electronic musical instrument 10*c*, the CPU 17 starts to execute a main routine shown in FIG. 18. The CPU 17 effects an initial setting processing at step 70*a* for initializing the RAM 18*c*. At this step 70*a*, all of bits of the key status memory KEYMEM, event data register section EVTR, pointer register PR and the other registers are reset to "0". On the other hand, all of bits of the first to Nth key-code registers KCR(1) to KCR(N), first to Nth channel status registers CHSR(1) to CHSR(N) and assigned channel status register ACHDR are rendered "1". Also, the contents of the assigned channel number register ACHNR are rendered "1". The CPU 17 further stores, respectively into the lower-end key code register LEKCR and the upper-end key code register UEKCR, the lower-end key code LEKC and the upper-end key code UEKC which are previously stored in the program ROM 16*c*. In this embodiment, the lower-end key code LEKC represents the lowest-pitch key of the keyboard 11, and the upper-end key code UEKC represents the key one to two octaves higher than the lowest-pitch key. The control switch status memory SWMEM is written with data representative of operation states of the control switch levers and variable resistors of the control switch panel 12 in accordance with control switch status signals fed from the control switch circuit 12*a*. These data are also supplied to the musical tone generating circuit 14*b* to determine the tone color and tone levels of the tone to be generated thereby.

Upon completion of the initial setting processing described above, the CPU 17 executes a key processing routine at the next step 71*a*. At this step 71*a*, the CPU 17 executes respective routines whose flow charts are shown in FIGS. 19 to 21 and 14 to thereby control generation of tones in accordance with depression and release of the keys on the keyboard 11.

The processing performed at the steps 72 and 73 of Fig. 18 is the same as that performed at the steps 72 and 73 of FIG. 11.

When the processing of the steps 73 is completed, the processing returns to the step 71*a*. Thus, the CPU 17 repeatedly carried out the steps 71*a* to 73 to control the generation of tones by the musical tone generating circuit 14*b* in accordance with the operation of the keyboard 11 and the control switch panel 12.

The key processing routine executed by the CPU 17 at the step 71*a* will now be more fully described with reference to the flow chart shown in FIG. 19.

Figure 19:
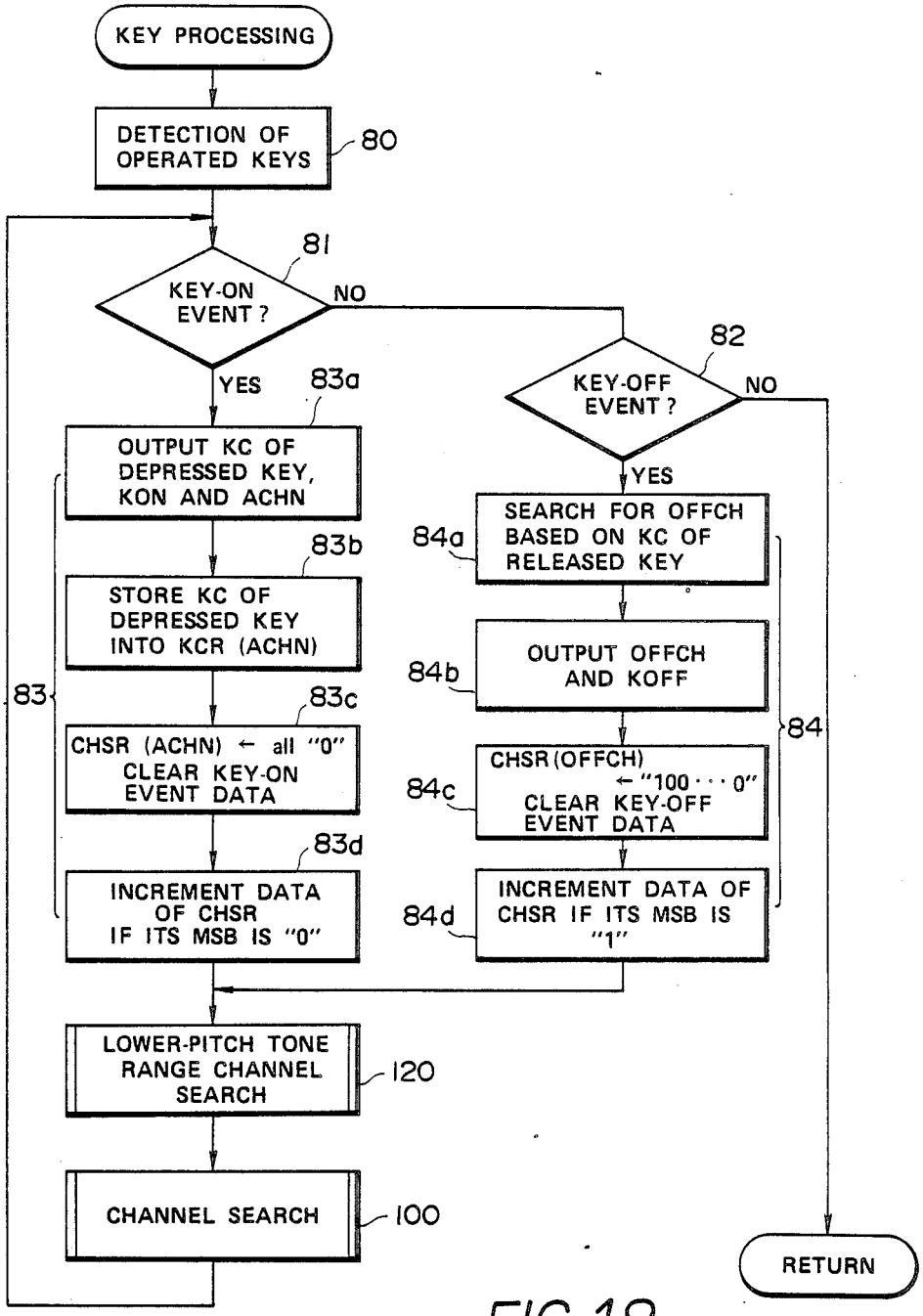
FIG. 19 is a flow chart of the key processing routine executed at the step 71*a* of FIG. 18.

The processing performed at the steps 80 to 82, 83*a* to 83*d*, 84*a* to 84*d* and 100 of FIG. 19 is the same as that performed at the corresponding steps of FIG. 12.

When the processing of the key-on event processing routine 83 is completed at the step 83*d* or when the processing of the key-off event processing routine 84 is completed at the step 84*d*, the CPU 17 executes at the next step 120 a lower-pitch tone range channel search routine to detect those tone generating channels which are generating tones within the tone range defined by the lower-end key code LEKC and the upper-end key code UEKC, as more fully described later. Then, the processing proceeds to the step 100 which is the same as that shown in FIG. 12.

The lower-pitch tone range channel search routine executed at the step 120 will now be more fully described with reference to the flow chart shown in FIG. 20.

This lower-pitch tone range channel search routine is provided for detecting those tone generating channels which are generating tones within the tone range defined by the lower-end key code LEKC and the upper-end key code UEKC. When the processing of this lower-pitch tone channel search routine is started, the CPU 17 effects, at step 121, an initialization of the pointer register PR by storing thereinto data representative of "0". At the next step 122, the CPU 17 adds "1" to data contained in the pointer register PR to render the data "1". Then, the CPU 17 determines, at the next step 123, whether the key code KC contained in the key-code register KCR(PR) designated by the data in the pointer register PR is not less than the lower-end key code LEKC and is not greater than the upper-end key code UEKC. In this case, the data in the pointer register PR is "1", so that the key code in the first key-code register KCR(1) is compared with the lower-end key code LEKC and the upper-end key code UEKC. When the first tone generating channel is generating a tone which belongs to the tone range, LEKC<KCR(1)<UEKC is established. And therefore, the result of the determination effected at this step 123 is "YES" in this case, so that the processing proceeds to the next step 124. At the step 124, the CPU 17 stores data whose bits are all "0" into the channel status register CHSR(PR) designated by the data contained in the pointer register PR. In this case, the data in the pointer register PR is "1", so that the contents of the first channel status register CHSR(1) are rendered "0". Then, the processing proceeds to the next step 125. On the other hand, if the first tone generating channel is not generating a tone which belongs to the tone range (i.e., if the first tone generating channel is generating no tone, or it is generating a tone which is outside of the aforesaid tone range), KCR(1)>UEKC is established. And therefore, the result of the determination effected at this step 123 becomes "NO", so that the processing proceeds directly to the step 125. At the step 125, the CPU 17 determines whether the data in the pointer register PR is equal to "N". In this case, the data in the pointer register PR is "1", so the determination result is "NO". Consequently, the processing returns to the step 122, whereupon "1" is added to the data contained in the pointer register PR to cause it to become "2". Then, the processing of the steps 123 to 125 is again carried out. The processing in a loop composed of the steps 122 to 125 is repeatedly carried out until the data in the pointer register PR becomes equal to "N". When the data in the pointer register PR reaches "N", the determination result at the step 125 becomes "YES", so that the processing of this lower-pitch tone range search routine is terminated. As a result of N times of executions of the processing in the aforesaid loop, the contents of the channel status registers corresponding to those tone generating channels which are generating tones within the tone range defined by the lower-end and upper-end key codes LEKC and UEKC are all rendered "0".

The processing performed at the step 100 of FIG. 19 is the same as the channel search processing shown in FIG. 14. When this channel search processing is completed, each of the first to Nth channel status registers CHSR(1) to CHSR(N) stores:

(1) data whose bits are all "1", if the corresponding tone generating channel is generating no tone signal;

(2) data whose MSB and remaining bits respectively represent "1" and a value which increases with the lapse of time from the release of the corresponding key, if the corresponding tone generating channel is generating a decaying tone signal;

(3) data whose MSB and remaining bits respectively represent "0" and a value which increases with the lapse of time from the depression of the corresponding key, if the corresponding tone generating channel is generating a tone signal of the key which is being depressed; or (4) data whose bits are all "0", if the corresponding tone generating channel is generating the tone which belongs to the aforesaid tone range.

And therefore, the assigned channel number ACHN (or the truncate channel number) contained in the assigned channel number register ACHNR represents:

(a) the smallest one of the channel numbers of those tone generating channels which are presently generating no tone signals, if there are one or more tone generating channels which are generating no tones;

(b) the channel number of that channel which is generating the tone of the earliest released key, if all of the channels are generating tones and if there are one or more channels which are generating tones of released keys except for the channels which are generating tones within the aforesaid tone range; or (c) the channel number of that channel which is generating the tone of the earliest depressed key, if all of the channels are generating tones and if all of the channels except for the channel generating the tones within the tone range are generating tones of keys which are presently depressed.

The operation of each tone generating channel performed at the time when the generation of tone signal is terminated will now be described.

When any one of the tone generating channels terminates the generation of tone signal, the musical tone generating channel outputs the tone generation termination signal DF and the tone generation termination channel data DFch to the microcomputer section 13*c*. When the tone generation termination signal DF and the tone generation termination channel data DFch are received by the microcomputer section 13*c*, the CPU 17 interrupts the execution of the main routine shown in FIG. 18 in response to the tone generation termination signal DF and, instead of this, begins to executes the DF interrupt routine shown in FIG. 21.

Figure 15:
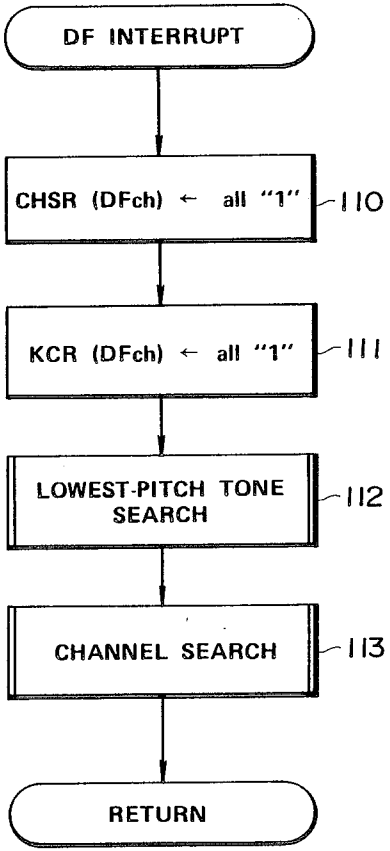
FIG. 15 is a flow chart of the DF interrupt routine executed by the CPU 17 in response to the signal DF outputted from the musical tone generating circuit 14*b* of FIG. 9.

This DF interrupt routine is the same as that shown in FIG. 15 except that it does not include the step 112. And, as a result of execution of this DF interrupt routine, all of the bits of the channel status register CHSR and key-code register KCR both corresponding to that channel which has just terminated the generation of tone are rendered "1".

With the above arrangement, when a key or keys is depressed on the keyboard 11, the key-on event processing routine 83 is executed in accordance with the key-on event data to renew the data in the key-code registers KCR(1) to KCR(N) and the channel status registers CHSR(1) to CHSR(N). When a key or keys is released on the keyboard 11, the key-off event processing routine 84 is executed in accordance with the key-off event data to renew the data in the key-code registers and the channel status registers. Then, the lower-pitch tone range channel search routine composed of the steps 121 to 125 is executed in accordance with the key codes KC stored in the key-code registers to detect the channels which are generating the tones within the tone ranges defined by the lower-end and upper-end key codes LEKC and UEKC, and at the same time the channel search routine composed of the steps 101 to 106 of FIG. 14 is executed to detect one of those channels currently generating tones except for the tones within the aforesaid tone range as the channel to which a newly depressed key is to be assigned. When a key is newly depressed on the keyboard 11, the key is assigned to the detected channel. Therefore, with this embodiment, the tones within the predetermined lower-pitch tone range will not forcibly be stopped even when depression of keys is performed in a quick manner, as is the case with a piano.

The above-described fourth embodiment is so constructed that the channels which are generating tones within the lower-pitch tone range are prevented from being assigned newly depressed keys. The fourth embodiment may, of course, be modified so that those channels which are generating tones within a middle-pitch tone range or a higher-pitch tone range are prevented from being assigned newly depressed keys. This can be achieved by modifying the step 70*a* of FIG. 18 so that the key code KC of the highest-pitch key of the keyboard 11 and the key code KC of the key one or two octave lower than the highest-pitch key are stored respectively into the upper-end key code register UEKCR and the lower-end key code register LEKCR. Alternatively, the step 70*a* may be modified so that key codes of the two keys one or two octave apart from one another and disposed in the middle of the keyboard 11 are selected and that the higher one and the lower one of the two key codes are stored respectively into the upper-end key code register UEKCR and the lower-end key code register LEKCR. According to these modifications, the tone range used in the step 123 as the reference tone range becomes the higher-pitch tone range or the middle-pitch tone range, and as a result, the channels which are generating tones within these tone ranges are prevented from being assigned newly depressed keys. Thus, it is possible to cause tones within the other tone ranges to be generated one after another at short time intervals while keeping the tones within the higher-pitch or middle-pitch tone range generated.

The fourth embodiment may also be modified to have a plurality of such specific tone ranges (for example, the lower-pitch tone range and the higher-pitch tone range). In this case, each of the upper-end and lower-end key code registers UEKCR and LEKCR must be composed of a plurality of registers. And, the CPU 17 stores predetermined key codes into these registers at the step 70a, and effects such comparison with respect to each tone range at the step 123.

With the fourth embodiment and the above-described modified form thereof, the channel which is generating a tone within the predetermined tone range (lower-pitch tone range, middle-pitch tone range or the higher-pitch tone range) is always prevented from being assigned newly depressed keys. The embodiment may be modified so that such prevention of assignment of the newly depressed keys can be selectively effected in accordance with performer's operation of a specific switch. In this case, the processing of the step 120 is effected only when the switch is closed to enable the prevention of assignment. On the other hand, when the switch is opened to disable the prevention of assignment, the step 120 is skipped.

With the fourth embodiment and the above-described modified forms thereof, the tone range is determined in accordance with the data stored in the program ROM 16c and is therefore can not be changed by the performer. However, the embodiment may be modified so that the performer can change the tone range. In this case, the control switch panel 12 and the control switch circuit 12a are modified to have a switch lever for selecting one of the plural tone ranges and a switch operatively connected to the switch lever, respectively. Also, the ROM 16c is modified to store the upper-end and lower-end key codes UEKC and LEKC with respect to each of the plural tone ranges. The steps 70a and 72 are also modified to write respectively into the upper-end and lower-end key code registers UEKCR and LEKCR the upper-end and lower-end key codes UEKC and LEKC which are read in accordance with the state of the switch lever.

Figure 22:
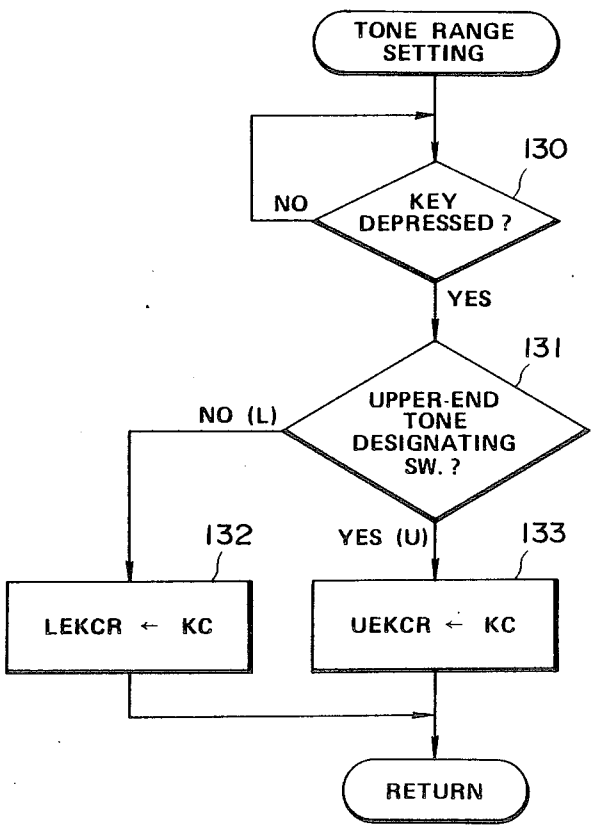
FIG. 22 is a flow chart of the tone range setting routine used in a modified form of the electronic musical instrument 10*c* of FIG. 16.

The embodiment may also be modified so that the performer can change the tone range through the keyboard 11. In this case, the control switch panel 12 must include a pair of switch levers for respectively enabling the upper-end and lower-end tones to be designated, and the control switch circuit 12a must include a pair of switches operatively connected to these designating switch levers. The programs stored in the ROM 16c is also so modified that a tone range setting routine whose flow chart is shown in FIG. 22 is executed by the CPU 17 at the step 72 when any one of the above-described designating switches is closed. When any of the switches is closed, the CPU 17 determines at step 130 of FIG. 22 whether there is any key depressed on the keyboard 11. The CPU 17 continues this determination operation until any is depressed. When a key is depressed on the keyboard 11, the result of the determination becomes "YES", so that the processing proceeds to the next step 131. At this step 131, the CPU 17 determines whether the above-described closed switch corresponds to the upper-end tone designating switch lever. If the determination result is "NO", that is, if it is determined that the closed switch corresponds to the lower-end tone designating switch, then the CPU 17 stores the key code KC of the depressed key into the lower-end key code register LEKCR at step 132. On the other hand, if the result of the determination at the step 131 is "YES", the CPU 17 stores the key code KC of the depressed key into the upper-end key code register UEKCR. When any of the processing of the step 132 or 133 is completed, this tone range setting routine is terminated.

Figure 20:
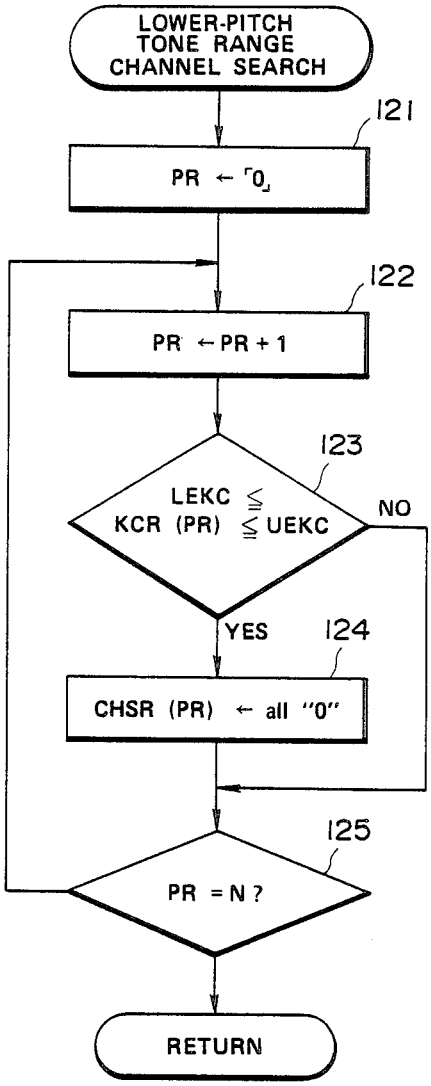
FIG. 20 is a flow chart of the lower-pitch tone range channel search routine executed at the step 120 of FIG. 19.
Figure 21:
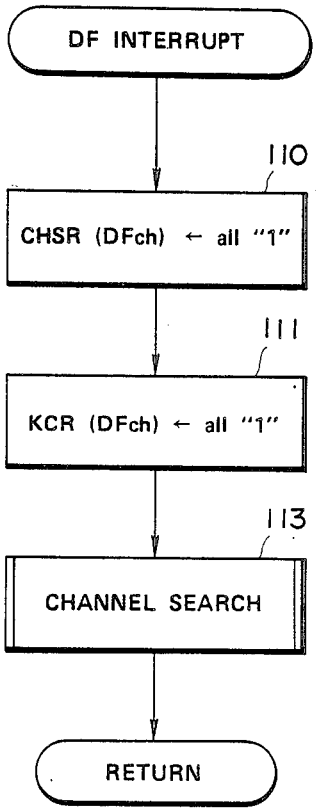
FIG. 21 is a flow chart of the DF interrupt routine executed by the CPU 17 in response to the signal DF outputted from the musical tone generating circuit 14*b;*

With this modified form, the reference tone range compared with the key code at the step 123 of FIG. 20 can be changed by the performer through the keyboard 11. Thus, it is possible for the performer to cause the electronic musical instrument 10c to generate tones within the other tone ranges one after another at short times intervals while keeping the tones within the tone range selected by himself sounded.

Figure 23:
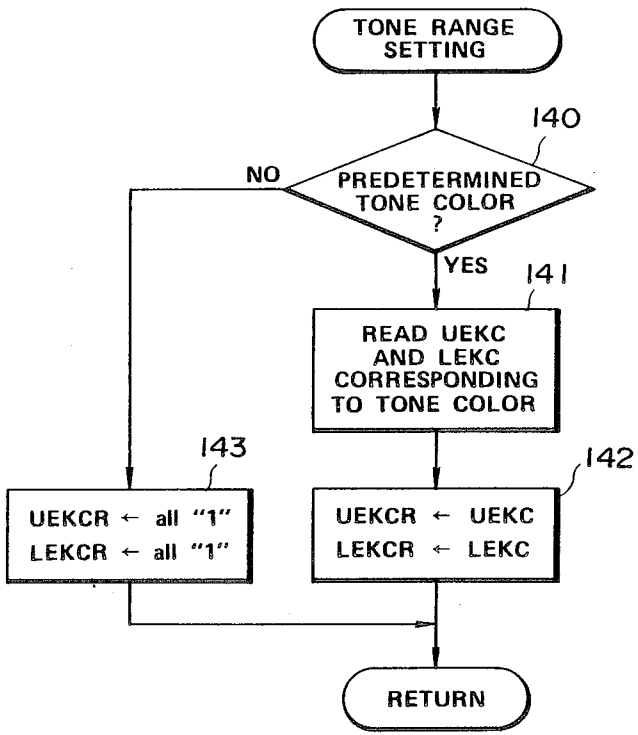
FIG. 23 is a flow chart the tone range setting routine used in another modified form of the electronic musical instrument 10*c* of FIG. 16.

The embodiment can also be modified so that such tone range is selected in accordance with the selection of tone color via the control switch panel 12. In this case, the ROM 16c is modified to store the upper-end and lower-end key codes UEKC and LEKC with respect to each of the tone colors and to store a tone range setting routine shown in FIG. 23. The tone colors with respect to each of which the the upper-end and lower-end key codes UEKC and LEKC must be stored exclude those tone colors which correspond to wind instruments having relatively short decay times such as a flute and an oboe. When closure of one of the control switches for selecting tone colors is detected at the step 72, the CPU 17 begins to execute the tone range setting routine of FIG. 23 at step 140. At this step 140, the CPU 17 determines whether the detected control switch corresponds to one of the tone colors with respect to which the setting of tone range should be performed. If the result of the determination at this step 140 is "YES", that is, if the detected control switch corresponds to one of the tone colors with respect to which the setting of tone range should be performed, the CPU 17 reads from the ROM 16c the upper-end and lower-end key codes UEKC and LEKC corresponding to this tone color at step 141. Then, the CPU 17 stores these upper-end and lower-end key codes UEKC and LEKC into the upper-end and lower-end key code registers UEKCR and LEKCR, respectively, at the next step 142. Then, the processing of this tone range setting routine is terminated. On the other hand, if the result of the determination at this step 140 is "NO", that is, if the detected control switch does not correspond to any of the tone colors with respect to which the setting of tone range should be performed, the CPU 17 writes data whose bits are all "1" into each of the upper-end and lower-end key code registers UEKCR and LEKCR at step 143, and this tone range setting routine is terminated. The writing of the data of "1" bits into the registers UEKCR and LEKCR means that no tone range is set to this electronic musical instrument. Thus, in this modified form of the embodiment, an automatic setting of the tone range is accompanied with selection of the specific tone colors.

With the fourth embodiment and its modified forms described above, the lower-pitch tone range channel search routine of FIG. 20 is executed to detect those channels which are generating tones within the specific tone range, and then, the channel search routine of FIG. 14 is executed to detect one of those channels currently generating tones except for the tones within the aforesaid specific tone range as the channel to which a newly depressed key is to be assigned. And, when a key is newly depressed on the keyboard 11, the key is assigned to the detected channel. The fourth embodiment and the modified forms thereof may be further modified so that the lower-pitch tone range channel search routine detects those channels which are generating tones outside of the specific tone range or generating no tone, and that the channel search routine detects one of thus detected channels as the channel to which a newly depressed key is to be assigned. In this case, the RAM 18c is modified to provide first to Nth flag registers for respectively storing flags each indicating whether a newly depressed key can be assigned to the corresponding tone generating channel or not. The lower-pitch tone range search routine is modified to set to "1" the flags corresponding to those channels which are generating tones outside of the tone range or generating no tone and to set to "0" those flags which correspond to the other tone generating channels. The assigned channel search routine is also so modified that one of the channels corresponding to the flags in the "1" state is assigned a newly depressed key.

With the fourth embodiment and the modified forms thereof, when all the tone generating channels of the musical tone generating circuit 14*b* are generating tones and any of them are generating decaying tones, those channels which are generating decaying tones outside of the specific tone range are selected. And, a newly depressed key is assigned at the highest priority to one of the selected channels which is generating the decaying tone of the earliest released key, as taught by Japanese Patent Application Publication No. 59-22238. However, the embodiment and the modified forms thereof may be modified so that a newly depressed key is assigned at the highest priority to that of the selected channels which is generating the decaying tone of the smallest envelope level, as taught by Japanese Patent Application Laid-Open No. 52-25613. To achieve this, the CPU 17 reads the envelope level data from those channels which are generating tones outside of the tone range when a key is newly depressed, and detects the channel number of the channel corresponding to the smallest one of the read envelope levels as the assigned channel number data ACHN. Then, the CPU 17 assigns the newly depressed key to the channel designated by the data ACHN.

With the fourth embodiment and the modified forms thereof, when a key is newly depressed on the keyboard 11 during the time when all the tone generating channels are generating tones of the keys presently depressed, the newly depressed key is assigned at the highest priority to the channel generating the tone of the earliest depressed one of the presently depressed keys except for the depressed keys within the tone range. The embodiment and the modified forms thereof may, however, be further modified so that assignment of the newly depressed key is not effected if all of the channels are presently generating tones. This can be achieved by modifying the programs so that assignment of the newly depressed key is inhibited if all of the MSBs of the first to Nth channel status registers CHSR(1) to CHSR(N) are "0".

A fifth embodiment of the invention will now be described.

Figure 24:
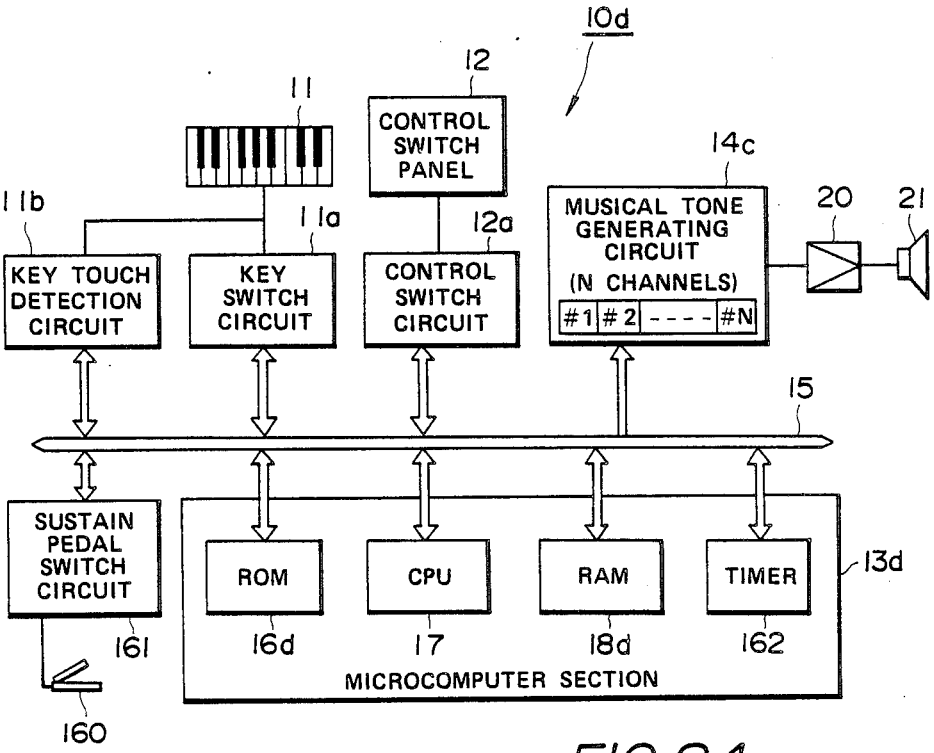
FIG. 24 is a block diagram of an electronic musical instrument 10*d* provided in accordance with a fifth embodiment of the invention.
Figure 25:
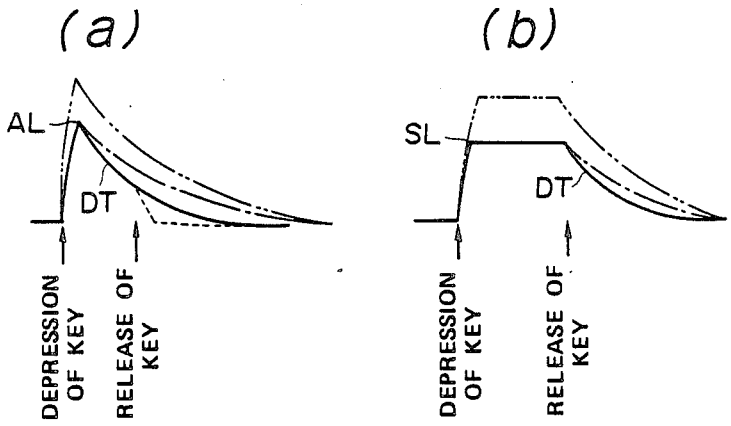
FIGS. 25(*a*) and (*b*) are illustrations showing envelope waveforms produced in the electronic musical instrument 10*d* of FIG. 24.

FIG. 24 is a block diagram of an electronic musical instrument 10*d* provided in accordance with the fifth embodiment of the invention. This electronic musical instrument 10*d* is suitable for generating tones of percussive musical instruments such as a piano and a harpsichord and differs in construction from the fourth embodiment of FIG. 16 in the following respects. The keyboard 11 is connected to a key touch detection circuit 11*b* of the conventional type which includes a plurality of key-on speed detection circuits (or key-on pressure detection circuits) each for detecting depressing strength (initial key touch) of a respective one of the keys on the keyboard 11 in accordance with the speed or pressure thereof. Key touch data representative of the detected key depression strength of each key is supplied from the key touch detection circuit 11*b* through the signal bus 15 to the CPU 17 of a microcomputer section 13*d*. The electronic musical instrument 10 d is provided with a sustain pedal 160 for controlling decaying time of each tone generated by the musical tone generating circuit 14*c*. When the sustain pedal 160 is stepped on, the decaying time of each tone is prolonged, while when the sustain pedal 160 is released the decaying time of each tone is shortened. The sustain pedal 160 is operatively connected, in the conventional manner, to a sustain pedal switch circuit 161 which detects the step-on and release of the sustain pedal 160 and outputs data representative of the step-on and release of the sustain pedal 160 through the signal bus 15 to the microcomputer section 13*d*. The musical tone generating circuit 14*c* is so constructed as to generate tone signals in accordance with the operation of the keyboard 11, control switch panel 12 and sustain pedal 160. As indicated by a solid line in FIG. 25-(*a*), an envelope waveform of each tone signal generated by the musical tone generating circuit 14*c* rapidly rises upon depression of the key and begins to gradually decay at a decay time constant DT irrespectively of the release of the key when the signal level of the tone signal reaches a predetermined attack level AL. During the depression of the key, the gradual decay of the tone signal continues, whereas if the key is released during the gradual decay, the tone begins to rapidly decay as indicated by a broken line in FIG. 25-(*a*). The envelope waveform of the tone signal is controlled in accordance with operation of the sustain pedal 160 and the keys of the keyboard 11 as hereunder described. When the key is released, the envelope waveform varies not along the broken line but along the solid line of FIG. 25-(*a*) if the sustain pedal 160 is in the stepped-on state. The lower the pitch of the generated tone signal, the greater the decay time constant DT, as indicated by a dot-and-dash line in FIG. 25-(*a*). The greater the key depression strength detected by the key touch detection circuit 11*b* (that is, the greater the key depression speed or the key depression pressure of the key), the greater the predetermined attack level AL, as indicated by a two dots-and-dash line in FIG. 25-(*a*). The decay time constant DT and the attack level AL are also varied in accordance with a tone color of the tone generated. Thus the decay time of the tone varies in accordance with the various factors of the tone, as is the case with tones of ordinary musical instruments such as a piano.

Figure 26:
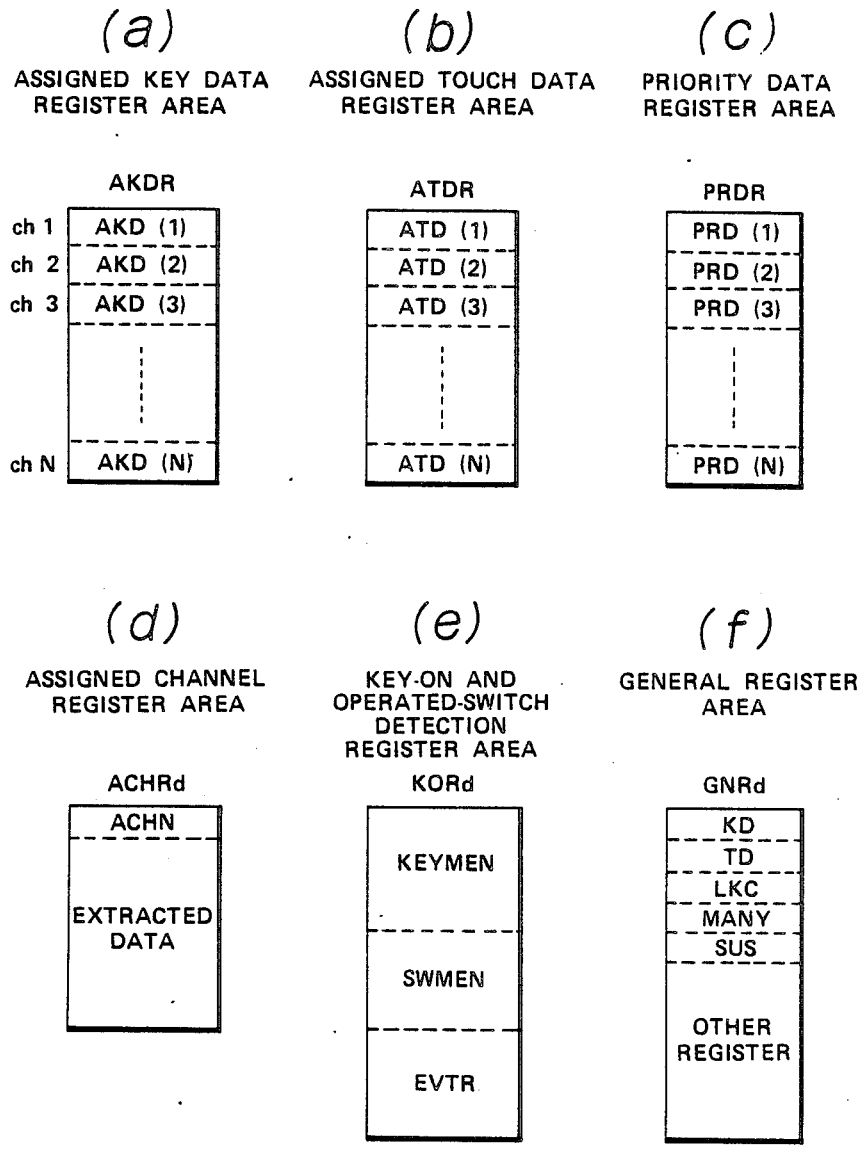
FIGS. 26(*a*)–(*f*) are illustrations showing various register areas provided in the RAM 18*d* of FIG. 24.

The microcomputer section 13*d* comprises in addition to the CPU 17, a ROM 16*d* storing various programs which will be described later, a RAM 18*d* used as data storage area during the execution of the programs by the CPU 17, and a timer 162 for measuring time to periodically interrupt the currently executed program and to start a timer interrupt routine shown in FIG. 30. As shown in FIG. 26, the RAM 18*d* of FIG. 24 is mapped to include an assigned key data register area AKDR (FIG. 26-(*a*)) for storing data relating to each of the keys assigned to the tone generating channels of the musical tone generating circuit 14*c*, an assigned touch data area ATDR (FIG. 26-(*b*)) for storing the touch data representative of the key depression strength of each of the keys assigned to the tone generating channels, and a priority data register area PRDR (FIG. 26-(*c*)) for storing the priority of key-assignment to each of the tone generating channels. The RAM 18*d* also comprises an assigned channel register area ACHRd (FIG. 26-(*d*)) for storing assigned channel data and other data, the assigned channel data designating the channel to which the key newly depressed on the keyboard 11 is to be assigned (i.e., the truncate channel). The RAM. 18*d* further comprises a key-on and operated-switch detection register area KORd (FIG 26-(*e*)) which is similar to the key-on and operated-switch detection, register area KORb of FIG. 10, and a general register GNRd (FIG. 26-(*f*)) which is used to carry out a calculation of the assigned channel and other calculations.

The assigned key data register area AKDR includes first to Nth registers corresponding respectively to the first to Nth tone generating channels of the musical tone generating circuit 14*c*. The first to Nth registers store first to Nth assigned key data AKD(1) to AKD(N), respectively, each composed of the key code KC representative of the key assigned to the corresponding channel and a key-on data KO representative of the ON state of the key. The value of the key code KC increases with the increase of the pitch of the tone of the corresponding key, and is within the range of between "21" and "108" in the case where the keyboard 11 has eighty eight keys. The key-on data KO is "0" when the corresponding key is in the OFF state (or released), and is "1" when the key is in the ON state (or depressed).

The assigned touch data register area ATDR comprises first to Nth register corresponding respectively to the first to Nth tone generating channel. The first to Nth registers in this assigned touch data register area ATDR store the touch data TD, corresponding to the keys designated by the assigned key data AKD(1) to AKD(N) in the assigned key data register area AKDR, as touch data ATD(1) to ATD(N), respectively. Each of the touch data TD increases with the increase of the key depression strength of the corresponding key. The priority data register area PRDR also comprises first to Nth registers corresponding respectively to the first to Nth tone generating channels. The first to Nth registers in this priority data register PRDR respectively store priority data PRD(1) to PRD(N), each representative of the priority of the key assigned to a respective one of the tone generating channels.

The assigned channel register area ACHRd comprises a register for storing assigned channel number data ACHN representative of the channel number of that channel to which the key newly depressed on the keyboard 11 is assigned, and also comprises a series of registers for storing the channel numbers and priority data PRD which are extracted in the processing for detecting the assigned channel number data ACHN.

The key-on and operated-switch detection register area KORd is similar to the key-on and operated-switch detection register area KORb of FIG. 10-(*d*), and comprises a key status memory KEYMEM, a control-switch status memory SWMEM and an event register section EVTR. The key event register section EVTR includes a plurality of registers for storing key-on event data KEVT1, key-off event data KEVT2 and control-switch event data SWEVT. Each key-on event data KEVT1 contains the key code KC, key-on data KO and touch data TD of the depressed key, and the key-off event data KEVT2 contains the key code KC and key-on data KO of the released key.

The general register area GNRd comprises a pair of registers for respectively storing the key data KD and touch data TD read from the key-on and operated-switch register area KORd during the processing of the key-on event data KEVT1, a register for storing a lowest-pitch key code LKC corresponding to the lowest-pitch tone detected by a lowest-pitch tone detecting processing, and a register for storing multiply-assigned channel number data MANY representative of the number of channels to which the same key is assigned. The general register area GNRd further comprises a register for storing sustain data SUS which is "1" when the sustain pedal 160 is in the stepped-on state and "0" when in the released state, and other registers for storing variables necessary for the microcomputer section 13*d* to effect calculations.

The operation of the electronic musical instrument 10*d* will now be described.

Figure 27:
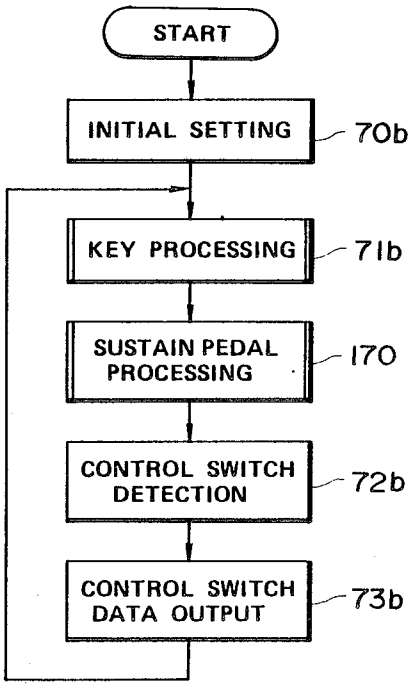
FIG. 27 is a flow chart of the main routine executed by the CPU 17 of FIG. 24.

In the first place, a main routine executed by the CPU 17 will be described with reference to a flow chart shown in Fig. 27. When power is applied to the electronic musical instrument 10*d* the CPU 17 begins the execution of the main routine at step 70*b*. At this step 70*b*, the CPU 17 initializes the contents of the RAM 18*d*. Then, the processing proceeds to the next step 71*b*, at which the CPU 17 executes a key processing routine shown in FIG. 28 to control the generation of tones by the tone generating channels of the musical tone generating circuit 14*c* in accordance with depression and release of keys of the keyboard 11. The key processing routine will be more fully described later. Then, the processing proceeds to the next step 170, at which the CPU 17 executes a sustain pedal processing routine shown in FIG. 33 to control the decay of each of the tones presently generated by the tone generating channels of the musical tone generating circuit 14*c* in accordance with step-on and release of the sustain pedal 160. The sustain pedal processing routine will be more fully described later. Then, the processing proceeds to the next step 72*b* and thence to step 73*b*. The processings performed at these steps 72*b* and 73*b* are the same as those performed at the steps 72 and 73 of FIG. 11. Then, the processing returns to the step 71*b*.

The key processing routine executed by the CPU 17 at the step 71*b* will now be more fully described with reference to the flow chart shown in FIG. 28.

At step 180, the CPU 17 detects depression and release of the keys on the keyboard 11. In this case, the CPU 17 scans all the key switches from the highest-pitch tone side or the lowest-pitch tone side to inputs ON/OFF states of the key switches as new key-status data. The CPU 17 then compares each of the new key-status data with a respective one of those stored in the key status memory KEYMEM to thereby detect changes of ON/OFF states of the keys, and if there are keys detected as depressed, the CPU 17 reads touch data relating to the depressed key from the key touch detection circuit 11*b*. More specifically, when the new key-status data is "1" and when the corresponding key-status data stored in the key status memory KEYMEM (i.e., the corresponding old key-status data) is "0", the CPU 17 determines that the corresponding key is newly depressed on the keyboard 11. In this case, the CPU 17 stores the new key-status data of "1" into the storage position of the key status memory KEYMEM which corresponds to the newly depressed key, and also stores, as the key-on event data KEVT1, the key data composed of the key code KC representative of the newly depressed key and the key-on data KO and the touch data TD representative of the depression strength of the newly depressed key into a register in the event data register section EVTR. When the new key-status data is "0" and when the corresponding old key-status data is "1", the CPU 17 determines that the corresponding key is newly released on the keyboard 11. In this case, the CPU 17 stores the new key-status data of "0" into the storage position of the key status memory KEYMEM which corresponds to the newly released key, and also stores, as a key-off event data KEVT2, the key data KD composed of the key code KC representative of the newly released key and the key-on data KO of "0", indicating that the key is newly released, into a register in the event data register section EVTR. The key codes KC may be formed from the contents of a scanning counter (not shown) for sequentially pointing the key switches corresponding respectively to the keys during the scanning thereof.

The processing then proceeds to the next step 181 at which the CPU 17 determines whether there is any key-on event data in the event data register section EVTR. If the determination result is "NO", the CPU 17 further determines, at step 182, whether there is any key-off event data in the event data register section EVTR. When there has been no change of states of the keys on the keyboard 11, the results of the above two determinations are both "NO", so that this key processing routine is terminated, and the processing proceeds from the step 182 to the step 170 of FIG. 27.

When there is any key newly depressed, the result of the determination at the step 181 is "YES", so that a key-on event processing routine 183 begins to be executed. The key-on event processing routine is composed of step 190 (channel search routine), step 200 (channel data setting routine) and step 220.

Figures 29, 30:
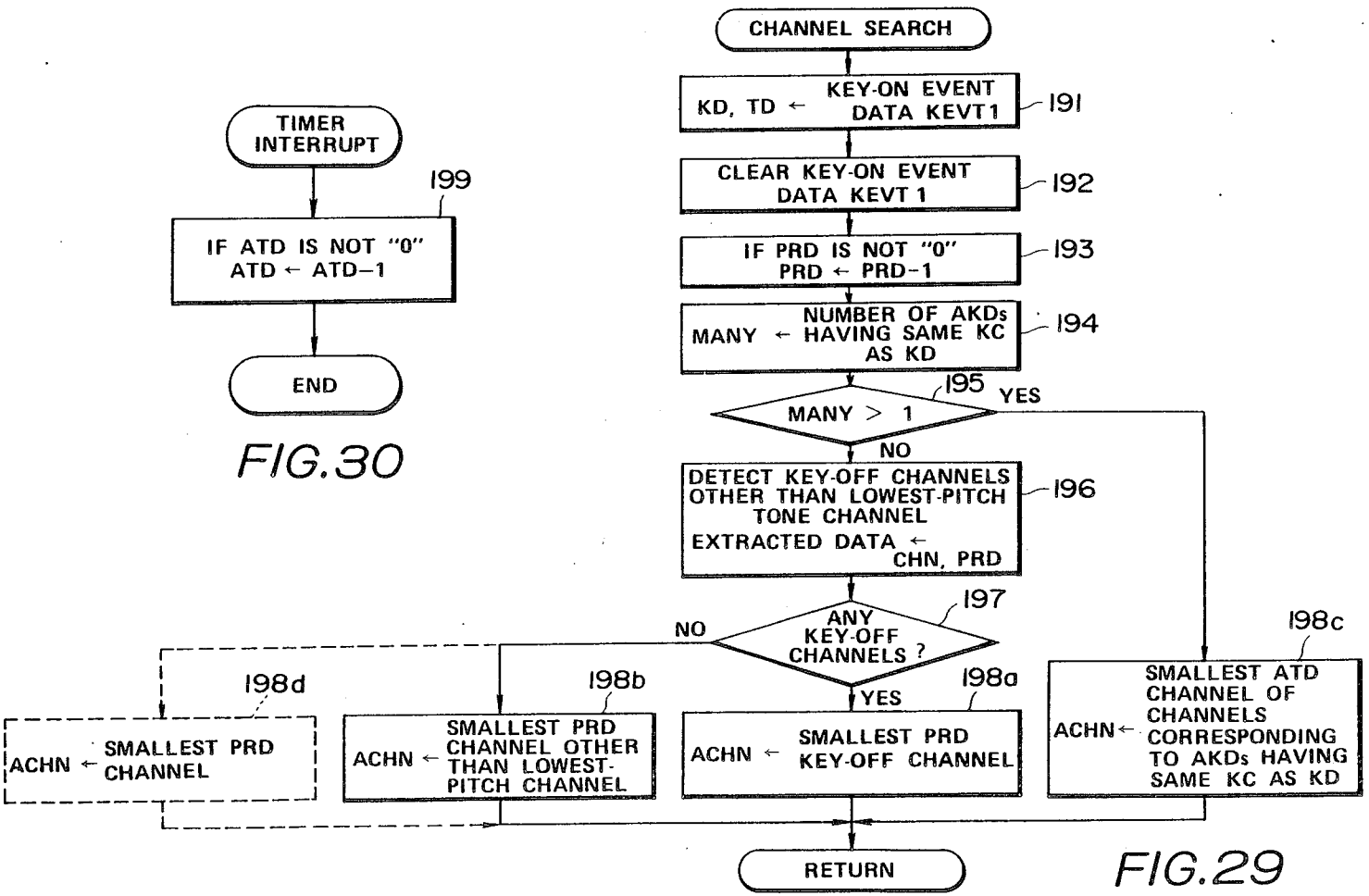
FIG. 29 is a flow chart of the channel search routine executed at the step 190 of FIG. 28.
FIG. 30 is a flow chart of the timer interrupt routine executed by the CPU 17 in response to the interrupt signal outputted from the timer 162 of FIG. 24.

The channel search routine of the step 190 is provided for determining the channel number of the channel to which the key newly depressed is assigned, and a flow chart of which is shown in FIG. 29. This channel search routine begins to be executed at step 191, at which the CPU 17 reads one of the detected key-on event data KEVT1 from the register section EVTR and stores the key data KD and the touch data TD thereof into the corresponding registers of the general register area GNRd. Then, the CPU 17 clears the thus read key-on event data KEVT1 from the register section EVTR, at the next step 192. At step 193, the CPU 17 reads each of the priority data PRD(1) to PRD(N) from the priority data register PRDR. In this case, if the read priority data PRD is not "0", the CPU 17 decrements the read priority data PRD by one and re-stores it into the corresponding register of the priority data register area PRDR. On the other hand, if the read priority data PRD is equal to "0", the CPU 17 does not change the contents of the corresponding register. Thus, each time a key is newly depressed on the keyboard 11, each of those priority data PRD which are not "0" is decremented by one. In other words, each time a key is newly depressed, the priority of each tone generating channel is enhanced. Then, the processing proceeds to the next step 194.

At this step 194, the CPU 17 sequentially reads the assigned key data AKD(1) to AKD(N) from the assigned key data register area AKDR, and compares each of the key code KC contained in the read assigned key data AKD with the key code KC contained in the key data KD stored in the general register area GNRd, to determine the number of the assigned key data AKD having the same key code KC as the key data KD in the general register area GNRd. The CPU 17 then stores the detected number in the general register area GNRd as the multiply-assigned channel number data MANY. When the same key is depressed twice or more during a predetermined number (in this embodiment; "N") of successive depressions of keys, as is the case with certain musical performances such as a trill, the maximum number of assignments of such key to the channels is determined based on the multiply-assigned channel number data MANY. In this embodiment, an assignment of the same key to more than two different channels is not allowed.

At the next step 195, the CPU 17 determines whether the data MANY is greater than "1". If the newly depressed key involved does not corresponds to the second depression of the same key during the predetermined number of successive depressions of keys, all the registers of the assigned key data register area AKDR contain key data KD having different key codes KC, so that the multiply-assigned channel number data MANY is "0". As a result, the result of the determination at the step 195 becomes "NO", and the processing proceeds to the next step 196. At this step, the CPU 17 sequentially reads the assigned key data AKD(1) to AKD(N) from the assigned key data register area AKDR, and detects those assigned key data AKD which include the key codes KC other than the lowest-pitch key code LKC and the key-on data KO in the state of "0". The CPU 17 then stores into the series of registers of the assigned channel register area ACHRd the channel numbers representative of the channels corresponding to the detected assigned key data AKD and the priority data PRD corresponding to these channels, as a group of extracted data. Thus, the tone generating channels which are not generating the lowest-pitch tone but generating tones of the released keys are detected. Then, the CPU 17 determines, at step 197, whether there is any extracted data in the series of registers of the assigned channel register area ACHRd, and if the result of this determination is "YES", then the processing proceeds to step 198*a*. At this step 198*a*, the CPU 17 detects the smallest one of the priority data PRD, stored in the assigned channel register area ACHRd as the extracted data, and stores the channel number data CHN corresponding to the detected smallest priority data into the same assigned channel register area ACHRd as the assigned channel number data ACHN. Then, this channel search routine is terminated.

If it is determined that there is no extracted data in the assigned channel register area ACHRd at the step 197, that is to say, if all of the channels except for that generating the lowest-pitch tone are generating tones of the keys presently depressed, the processing proceeds from the step 197 to step 198*b*. At this step 198*b*, the CPU 17 detects the channel which corresponds to the smallest one of the priority data PRD(1) to PRD(N) except for the priority data PRD which corresponds to the channel whose assigned key data AKD contains the key code KC equal to the lowest-pitch key code LKC. The CPU 17 stores the channel number data CHN representative of the detected channel into the assigned channel register area ACHRd as the assigned channel number data ACHN, and then terminates this channel search routine.

At the step 194, if the newly depressed key involved corresponds to the second depression of the same key during the predetermined number of successive depressions of keys, the data MANY is rendered "1", and if the third depression, the data MANY is rendered "2".In the case of the data MANY being "2" for example (Many can be any integer K where $2 \leqq K \leqq N-1$), the result of the determination at the step 195 is "YES", so that the processing proceeds to step 198*c*. At this step 198*c*, the CPU 17 sequentially reads the assigned key data AKD(1) to AKD(N) from the assigned key data register area AKDR and compares the key code contained in each of the read assigned key data AKD with the key code KC of the key data KD representative of the newly depressed key. The CPU 17 thus detects the channels to which the same key code KC are assigned. Then, the CPU 17 detects the smallest one of those assigned touch data ATD in the assigned touch data register area ATDR which correspond to the detected channels, and stores the channel number of the channel corresponding to the thus detected smallest assigned touch data ATD into the assigned channel register area ACHRd as the assigned channel number data ACHN. Then, the CPU 17 terminates the processing of this channel search routine. Thus, the processing of the step 198*c* serves to limit the number of channels to which the same key are assigned to "2". If desired, the number of channels may be changed to "3" by replacing the reference value "1" compared with the data MANY by "2" (or any other suitable integer $K \leqq N-1$). Each of the touch data ATD is stored in the assigned touch data register area ATDR by the channel data setting routine as later described, each time the corresponding key is newly depressed. Thereafter, each touch data ATD is periodically renewed by the timer interrupt routine shown in FIG. 30.

The timer 162 of FIG. 24 periodically outputs an interrupt signal to the CPU 17. In response to this interrupt signal, the CPU 17 stops the currently executing program and starts the timer interrupt routine. At step 199, the CPU 17 sequentially reads the assigned touch data ATD(1) to ATD(N) from the assigned touch data register area ATDR, and subtracts "1" from each of them if its value is not "0". In this case, those assigned touch data ATD of which values are equal to "0" are left unchanged. The CPU 17 then stores the assigned touch data ATD(1) to ATD(N) thus renewed into the assigned touch data register area ATDR. Thus, each of the assigned touch data ATD(1) to ATD(N) decreases with the lapse of time.

The processing at the step 198*b* of FIG. 29 may be replaced by the processing at step 198*d*, as indicated by a broken line. At the step 198*d*, the CPU 17 detects the smallest one of the priority data PRD(1) to PRD(N) irrespectively of the channel which is generating the lowest-pitch tone, and stores the channel number CHN representative of the channel corresponding to this detected smallest priority data PRD into the assigned channel register area ACHRd as the assigned channel number data ACHN.

Figure 28:
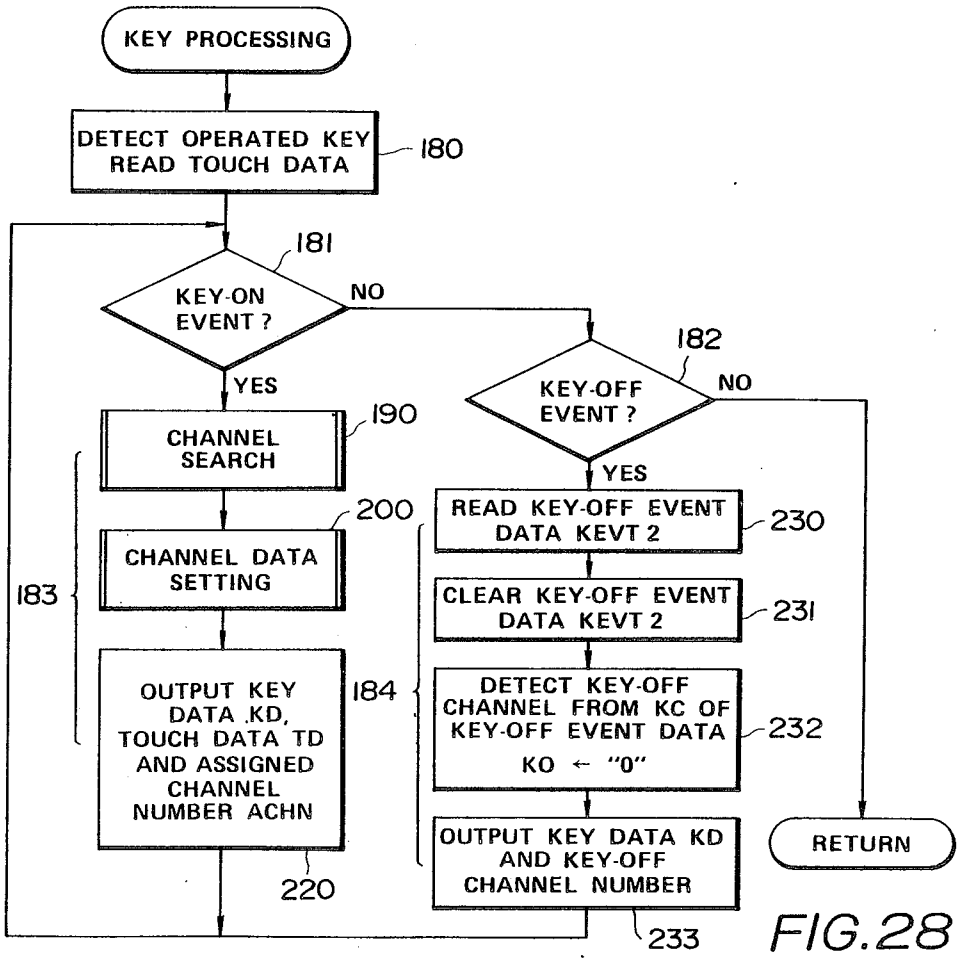
FIG. 28 is a flow chart of the key processing routine executed at the step 71*b* of FIG. 27.
Figure 31:
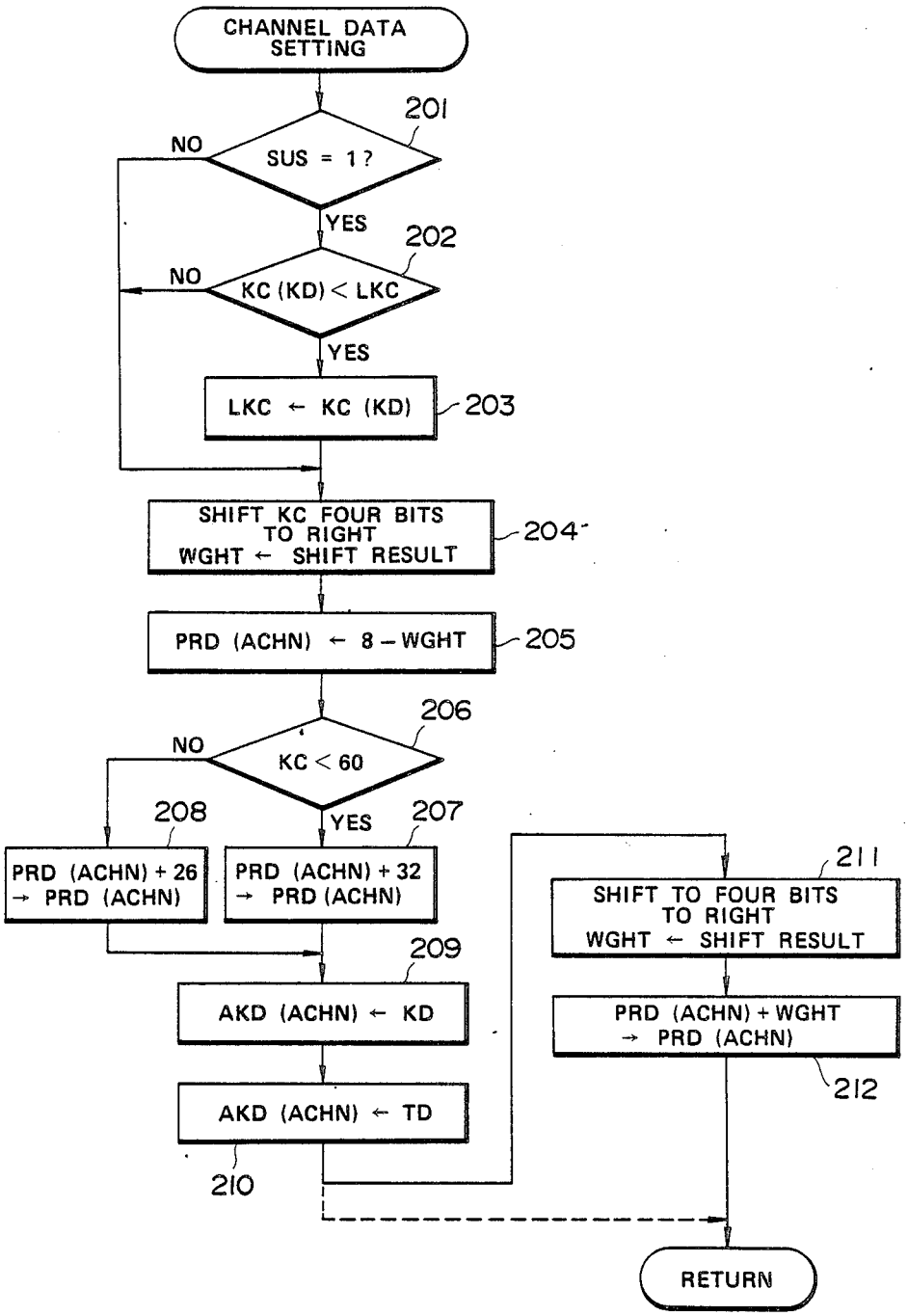
FIG. 31 is a flow chart of the channel data setting routine executed at the step 200 of FIG. 28.

Upon completion of the execution of the above-described channel search routine at the step 190 of FIG. 28, the CPU 17 begins to execute, at step 200, the channel data setting routine shown in FIG. 31, wherein setting of data including the priority data PRD(ACHN), assigned key data AKD(ACHN) and assigned touch data ATD(ACHN) all designated by the assigned channel number data ACHN obtained by the above-described step 190 is effected.

When the execution of the channel data setting routine is started, the CPU 17 determines at step 201 whether the sustain pedal 160 is in the stepped-on state in accordance with the sustain data SUS stored in the general register area GNRd. If the sustain pedal 160 is in the stepped-on state, the result of the determination at the step 201 is "YES", so that the CPU 17 further determines at the next step 202 whether the key code KC contained in the key data KD representative of the newly depressed key is smaller than the lowest-pitch key code LKC representative of the presently generated lowest-pitch tone. If the result of the determination at the step 202 is "YES", the CPU 17 replaces the lowest-pitch key code LKC by the key code KC corresponding to the newly depressed key at the next step 203. On the other, if the result of the determination at the step 202 is "NO", the processing proceeds from the step 202 directly to step 204. Thus, when a key is newly depressed on the keyboard 11 during the time when the sustain pedal 160 is in the stepped-on state and when the tone pitch of the newly depressed key is lower than any of those keys which have been assigned to the channels, the lowest-pitch key code LKC is replaces by the key code KC of the newly depressed key. On the other hand, if the sustain pedal 160 is in the released state, the result of the determination at the step 201 is "NO", so that the processing proceeds from the step 201 directly to the step 204. In this case, no detection of the lowest-pitch key is effected.

At the step 204, the CPU 17 again reads the key code KC contained in the key data KD from the general register area GNRd, and shift the bits of the key code KC in the right-hand direction (or in the direction of the lower-order bits) to thereby divide the key code KC by "16". The CPU 17 thus obtains the result of the division as a variable WGHT. At the next step 205, the CPU 17 subtracts the variable WGHT from data equal to "8", and stores the subtraction result into the priority data register area PRDR at the position designated by the above-described assigned channel number data ACHN as the priority data PRD(ACHN). Thus, the priority data PRD(ACHN) is such a data which decreases by one every sixteen tones with the increase of the key code KC within the tone range of between the $A_0$ tone and $A_8$ tone, and varies within the range of between "7" and "2". It will be appreciated from this that the lower the pitch of the depressed key, the lower priority the depressed key is given.

Figure 32:
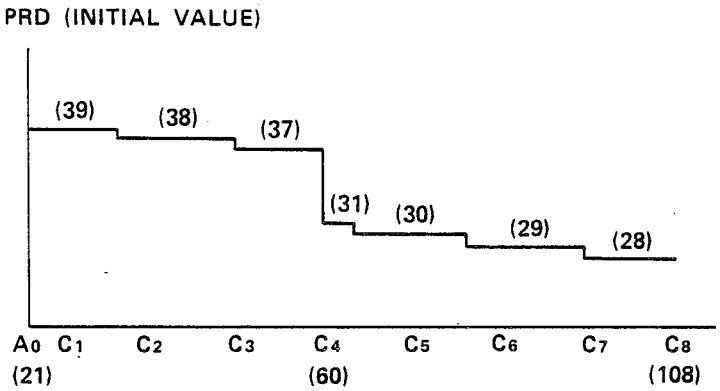
FIG. 32 is an illustration showing the relation between the priority data PRD and the tone pitch.

The CPU 17 then determines at the next step 206 whether the key code KC contained in the key data KD of the newly depressed key is smaller than "60". If the result of this determination is "YES", then the CPU 17 adds "32" to the priority data PRD(ACHN) at step 207. On the other hand, if the result of the determination at the step 206 is "NO", the CPU 17 adds "26" to the priority data PRD(ACHN) at step 208. The data of "60" corresponds to the key code of the $C_4$ tone, so that the priority data PRD(ACHN) for the keys below the $C_4$ tone is further increased in comparison with those priority data for the keys above the $C_4$ tone. This means that the priority of assignment of those keys below the $C_4$ tone is further lowered. FIG. 32 shows the relation between the keys and the priority data PRD from which it will be appreciated that in the case of the keyboard 11 having a tone range of between the $A_0$ tone and the $C_8$ tone, the priority data PRD(ACHN) takes any one of the values within the two ranges of between "39" and "37" and between "31" and "28".

Then, the processing proceeds from the step 207 or the step 208 to step 209, at which the CPU 17 reads the key data KD of the newly depressed key from the general register area GNRd and stores it into the assigned key data register area AKDR at the position determined by the assigned channel number data ACHN as the assigned key data AKD(ACHN). At the next step 210, the CPU 17 reads the touch data TD of the newly depressed key from the general register area GNRd and stores it into the assigned touch data register area at the position designated by the assigned channel number data ACHN as the assigned touch data ATD(ACHN).

At the next step 211, the CPU 17 again reads the touch data TD of the newly depressed key from the general register area GNRd, and shifts the bits thereof in the right-hand direction to divide the touch data by "16". The CPU 17 thus provides the result of the above division as the variable WGHT. At the next step 212, the CPU 17 adds the variable WGHT to the priority data PRD(ACHN) to further weight the priority data PRD(ACHN) with the variable WGHT so that the priority of key assignment is lowered with the increase of the touch data TD. Then, the CPU 17 terminates the processing of this channel data setting routine and transfers the control thereof to the step 220 of FIG. 28. It will be evident that the shift number at each of the steps 204 and 211 and the reference value at the step 206 may be changed to any desired values. Also, if there is no key touch detection circuit or if the weighting of each priority data PRD with the corresponding touch data TD is not necessary, the channel data setting routine may be modified to skip the steps 211 and 212 as indicated by a broken line in FIG. 31.

At the step 220 of FIG. 28, the CPU 17 reads the key data KD and the touch data TD from the general register area GNRd and outputs them to the musical tone generating circuit 14*c*. The CPU 17 also reads the assigned channel number data ACHN from the assigned channel register area ACHRd and outputs it to the musical tone generating circuit 14*c*. The musical tone generating circuit 14*c* selects the tone generating channel designated by the assigned channel number data ACHN and causes the selected tone generating channel to generate a tone having a pitch designated by the key code KC in the key data KD in response to the key-on data KO in the key data KD. In this case, the attack level of the generated tone is determined by the touch data TD, and the decay time constant DT of the envelope of the generated tone is determined based on the key code KC. Also, if the selected tone generating channel has been generating another tone, the generation of this another tone is stopped, and instead of this, the above-described tone begins to be generated. In this case, it is desirable to have the another tone rapidly decay before the change of generation of tone to avoid a click noise which may accompany with such change.

When the processing at the step 220 is completed, the processing returns to the step 181, and the processing in a loop composed of the steps 181, 190, 200 and 220 is repeatedly carried out until all of the key-on event data KEVT1 in the register section EVTR of the key-on and operated-switch detection register area KORd are processed. When all of the key-on event data KEVT1 are processed, the result of the determination at the step 181 becomes "NO", so that the processing proceeds to the step 182. If there is no key-off event data KEVT2 in the register section EVTR of the key-on and operated-switch detection register area KORd, the result of the determination at the step 182 is also "NO", so that the processing proceeds to the step 170 of FIG. 27. On the other hand, if there is any key-off event data KEVT2, the result of the determination at the step 182 is "YES", so that a key-off event processing routine 184 including steps 230 to 233 begins to be executed.

When the key-off event processing is started, the CPU 17 reads, at the step 230, one of the key-off event data KEVT2, which includes the key data KD, from the register section EVTR of the key-on and operated-switch detection register area KORd. The CPU 17 then stores the read key data KD into the general register area GNRd. At the next step 231, the CPU 17 clears, from the register section EVTR, the key-off event data KEVT2 of which key data KD has just been read. At the next step 232, the CPU 17 reads the key data KD from the general register GNRd, and detects based on this key data KD one of the assigned key data AKD(1) to AKD(N), which has the same key code KC as the key data KD and has the key-on data KO in the state of "1", from the assigned key data register area AKDR. Then, the CPU 17 changes the state of key-on data KO in the detected assigned key data AKD from "1" to "0". At the next step 233, the CPU 17 outputs to the musical tone generating circuit 14*c* the detected key data AKD, of which key-on data KO has been changed from "1" to "0", and the channel number CHN corresponding to the detected key data AKD. Thus, the decay of the tone generated by the tone generating channel designated by the channel number CHN is controlled. Then, the processing returns from the step 233 to the step 181 to form a loop composed of the steps 181, 182, 230, 231, 232 and 233.

The processing in the loop is repeatedly carried out until all of the key-off event data KEVT2 are cleared from the register section EVTR. When all of the key-off event data KEVT2 are cleared, the result of the determination at the step 182 becomes "NO", so that the processing proceeds from the step 182 to the step 170 (FIG. 27) for executing the sustain pedal processing routine.

Figure 33:
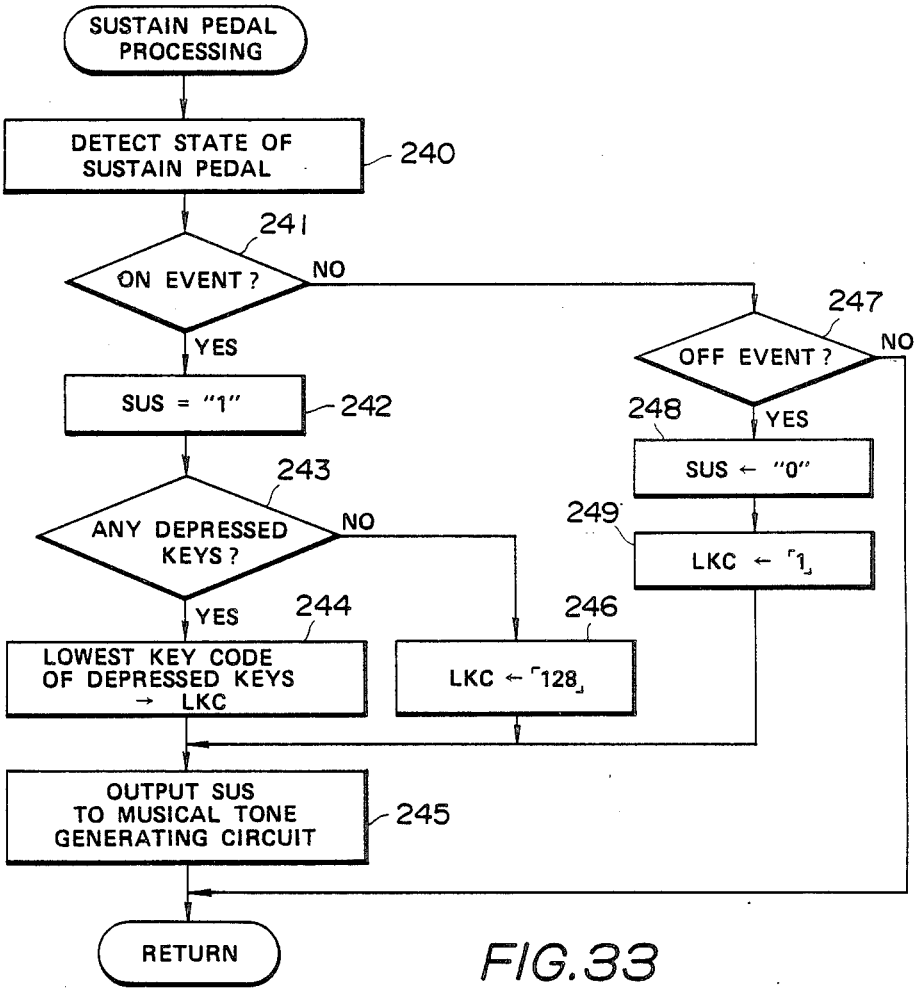
FIG. 33 is a flow chart of the sustain pedal processing routine executed at the step 170 of FIG. 27.

The sustain pedal processing routine will now be described with reference to a flow chart shown in FIG. 33. When the execution of this sustain pedal processing routine starts, the CPU 17 reads from the sustain pedal switch circuit 161 data representative of the current status of the sustain pedal 160. At the next step 241, the CPU 17 compares this status data with the sustain data SUS in the general register area GNRd to determine whether the sustain pedal 160 is newly stepped on (i.e., whether there is an on-event of the sustain pedal 160), the sustain data SUS representing the preceding status of the sustain pedal 160. When the sustain pedal 160 is newly stepped on, the status data read from the sustain pedal switch circuit 161 is "1" while the sustain data SUS in the general register area GNRd is "0", so that the result of the determination at the step 241 is "YES". As a result, the processing proceeds to step 242 at which the CPU 17 changes the state of the sustain data SUS from "0" to "1". At the next step 243, the CPU 17 sequentially reads the assigned key data AKD(1) to AKD(N), and determines whether there are any assigned key data AKD whose key-on data KO is in the "1" state. If it is determined that there are the assigned key data AKD having the key-on data of "1" or corresponding to the depressed keys, the processing proceeds to step 244. At this step 244, the CPU 17 detects one of the aforesaid assigned key data AKD which includes the smallest key code KC, and stores the smallest key code KC into the general register area GNRd as the lowest-pitch key code LKC. Then, the processing proceeds to the next step 245. On the other hand, if it is determined at the step 243 that there is no assigned key data AKD having the key-on data KO of "1", the processing proceeds to step 246. At the step 246, the CPU 17 stores into the general register area GNRd data greater than the key code KC equal to "108" of the $C_8$ tone of the keyboard 11 (for example, data equal to "128") as the lowest-pitch key code LKC. Then, the processing proceeds to the step 245, at which the CPU 17 outputs the sustain data SUS to the musical tone generating circuit 14*c* and then terminates the execution of this sustain pedal processing routine. In this case, the sustain data SUS outputted to the musical tone generating circuit 14*c* is in the state of "1", so that the musical tone generating circuit 14*c* stores the sustain data SUS of "1" and control the decaying characteristic of the tone generated by each of the channels in accordance with this sustain data SUS, whereby the tone decays gradually as indicated by the solid line in FIG. 25-(*a*) even when the key is released.

On the other hand, when the sustain pedal 160 is newly released, the status data read from the sustain pedal switch circuit 161 is "0" while the sustain data SUS in the general register area GNRd is "1", so that the result of the determination at the step 241 is "NO", whereas the result of the determination at the step 247 is "YES". As a result, the processing proceeds to step 248 at which the CPU 17 changes the state of the sustain data SUS from "1" to "0". At the next step 249, the CPU 17 stores into the general register area GNRd data smaller than the key code KC equal to "21" of the $A_0$ tone of the keyboard 11 (for example, data equal to "1") as the lowest-pitch key code LKC. Then, the processing proceeds to the step 245. In this case, the sustain data SUS is in the "0" state, so that each channel of the musical tone generating circuit 14*c* generates the tone in accordance with this sustain data of "0". As a result, the tone generated by each tone channel rapidly decays as indicated by the broken line in FIG. 25-(*a*) when the corresponding key is released. Then, this sustain pedal processing routine is terminated.

If the state of the sustain pedal 160 has not been changed, the status data of sustain pedal 160 read from the sustain pedal switch circuit 161 coincides to the sustain data SUS contained in the general register area GNRd, so that the results of the both determinations effected at the steps 241 and 247 are "NO". As a result, this sustain pedal processing routine is terminated, and the processing proceeds to the step 72*b* of FIG. 27.

The above-described fifth embodiment can be modified to generate sustain-type tones such as those of a flute and a violin. As indicated by a solid line in FIG. 25-(*b*), an envelope of such a sustain-type tone rapidly rises upon depression of a key, maintains a constant signal level SL during the depression of the key, and gradually decays in accordance with a decay time constant DT when the key is released. Thus, such a tone begins to decay from the release of the corresponding key. And therefore, the above embodiment must be modified so that the decrement of the priority data PRD is effected only with respect to the released-key channels each time a key is released. More specifically, the processing of the step 193 is removed from the channel search routine of FIG. 29. And, instead of this, a step for decrementing the priority data PRD with respect to those channels which are generating tone of the released keys is added to the key-off event processing routine 184 of FIG. 28. The decay time constant DT of such a tone becomes greater in the higher tone range as indicated by a dot-and-dash line in FIG. 25-(*b*). Also, the signal level SL becomes greater when the key is depressed stronger as indicated by a two dots-and-dash line in FIG. 25-(*b*). In this case, it is desirable to use after-touch sensors each for detecting strength of depression of the corresponding key. And, the programs are modified so that the priority data PRD are weighted with outputs of these sensors. More specifically, the steps 211 and 212 is deleted from the channel data setting routine of FIG. 31, and inserted after the step 232 or 233 of the key processing routine of FIG. 28. In this case, the weighting is effected with respect to those priority data PRD designated by the key-off channel number rather than those designated by the assigned channel number ACHN.

In the case where this embodiment is applied to an electric musical instrument in which a depressed key is simultaneously assigned to a plurality of tone channels to generate tones of different tone colors, the programs may be modified so that the priority data PRD are also weighted with data relating to the tone colors.

Figure 34:
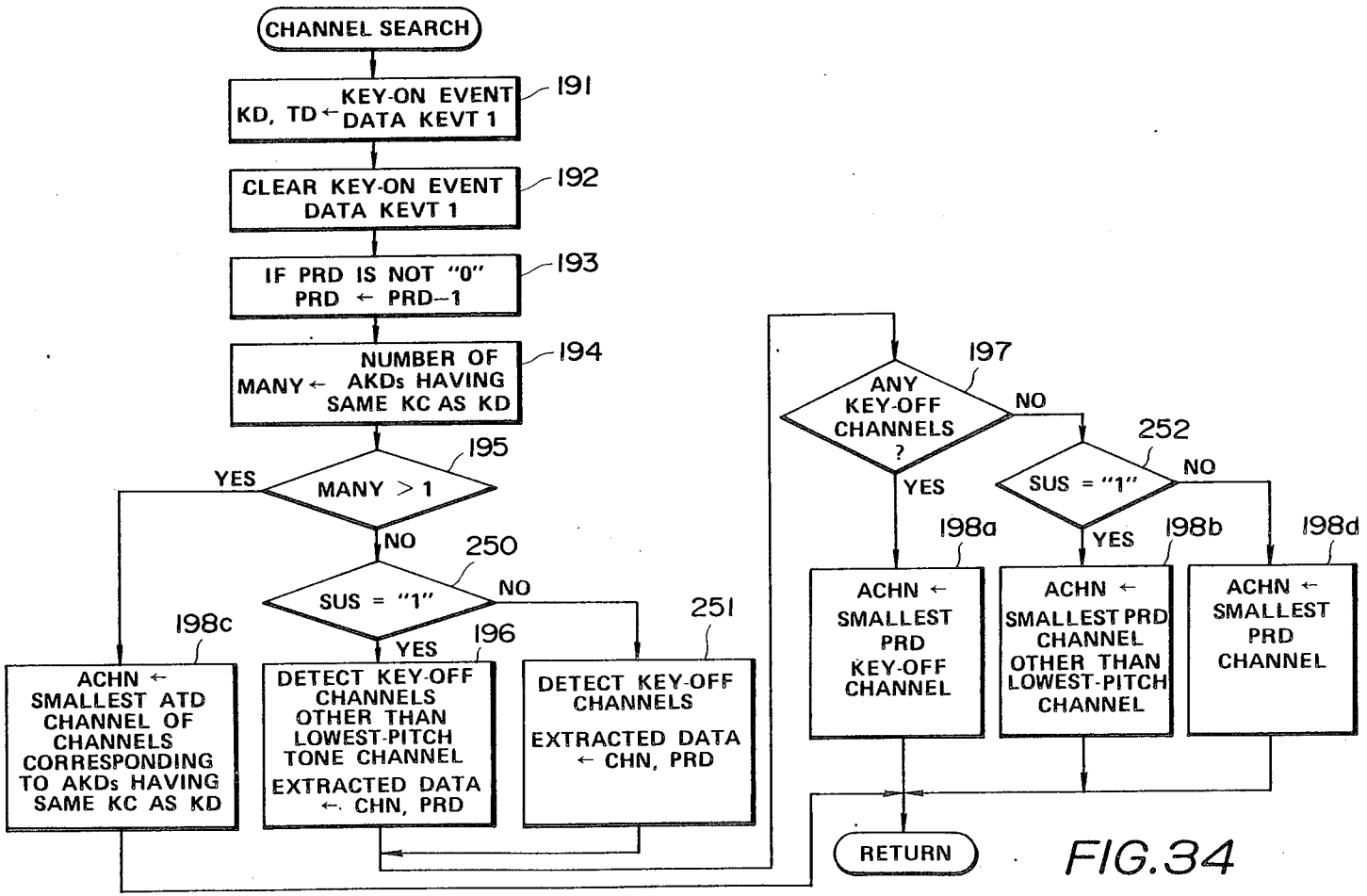
FIG. 34 is a flow chart of the channel search routine used in a modified form of the electronic musical instrument 10*d* of FIG. 24.

With the fifth embodiment, when the sustain pedal 160 is in the released state, the lowest-pitch key code LKC is cleared at the step 249 to enable the newly depressed key to be assigned even to the channel generating the lowest-pitch tone. This can also be achieved by modifying the processing effected in the channel search routine of FIG. 29 into that shown in FIG. 34. The channel search routine of FIG. 34 is added with steps 250, 251 and 252. At the step 250, the CPU 17 determines whether the sustain pedal 160 is in the stepped-on state in accordance with the sustain data SUS. If it is determined that the sustain pedal 160 is in the stepped-on state, the CPU 17 detects those assigned key data AKD which include the key codes KC other than the lowest-pitch key code LKC and the key-on data KO in the state of "0" at the step 196. The CPU 17 then stores into the series of registers of the assigned channel register area ACHRd the channel numbers CHN representative of the channels corresponding to the detected assigned key data AKD and the priority data PRD corresponding to these channels as the extracted data. On the other hand, if it is determined at the step 250 that the sustain pedal 160 is in the released state, the CPU 17 detects the assigned key data AKD relating to the released keys irrespective of the tone pitches thereof at the step 251, and stores the channel numbers and the priority data PRD of the detected assigned key data AKD. And if there ate any detected key-off channels, the assigned channel number ACHN is determined in accordance with the priority data corresponding to the detected key-off channels at the step 198*a* or the step 198*b*. On the other hand, if there is no detected key-off channel, the state of the sustain pedal 160 is again determined at the step 252. If it is determined that the sustain pedal 160 is in the stepped-on state, the lowest-priority one of the channels generating tones other than the lowest-pitch tone is assigned the newly depressed key at the step 198*b*. On the other hand, if it is determined that the sustain pedal 160 is in the released state, the lowest-priority one of the detected key-off channels is assigned the newly depressed key at the step 198*d*.

Although the above embodiment is so arranged that the channel, which is generating the lowest-pitch tone, is prevented from being assigned the newly depressed key, the embodiment can be arranged so as to effect such prevention of key-assignment to any of the following channels by modifying the processing for setting the lowest-pitch key code LKC and the processing of each of the steps 196 and 198*b*:

(i) the channel to which the highest-pitch key has been assigned;

(ii) the channels to which the two or three (or Kth, K≧2)lowest-pitch or highest-pitch keys are assigned;

(iii) the channels to which the keys within a tone range of one or two octaves above the assigned lowest-pitch key are assigned;

(iv) the channels to which the keys within a predetermined tone range (for example, a lower tone range, a middle tone range or a higher tone range) are assigned; or (v) the channels obtained by combining (i) to (iv).

In the case where the decay time of each of the tone generated by the channels are long enough or where there is no sustain pedal, the processing for the above-described prevention of assignment of the newly depressed key may be effected irrespectively of the state of the sustain pedal.

What is claimed is:

1. An electronic musical instrument comprising:

tone data generating means for generating tone data each representative of a tone to be generated;

tone generating means having a plurality of tone generating channels;

assigning means for assigning said tone data to said tone generating channels, each of said tone generating channels being assigned one of said tone data;

truncate data generating means for generating a group of truncate data each relating to a respective one of said tone data; and modifying means for modifying each of said group of truncate data in accordance with a respective one of said tone data assigned to said plurality of tone generating channels, to thereby produce a group of modified truncate data;

said tone data generating means further generating new tone data representative of a new tone; and said assigning means comprising channel designating means which designates a specified one of said tone generating channels in accordance with said group of modified truncate data and further assigning said new tone data to said specified channel so that said new tone data is substituted for the assigned one in said specified channel.

2. An electronic musical instrument according to claim 1, wherein said channel designating means comprises determining means for determining, with respect to each of said tone data generating channels, tone-data assigning priority representing priority of an assignment of said new tone data to each of said tone generating channels in accordance with the magnitude of each data of said group of modified truncate data, and designates a tone generating channel corresponding to the tone-data assigning priority equal to a predetermined priority as said specific channel.

3. An electronic musical instrument according to claim 2, wherein said truncate data generating means comprises envelope data generating means for generating a group of envelope data each representative of an envelope amplitude of a respective one of the tones generated by said tone generating channels, each of said truncate data representing the envelope amplitude of a respective member of said group of envelope data.

4. An electronic musical instrument according to claim 2, wherein said truncate data generating means comprises decay time simulating means for producing a group of decay-time data each representative of a lapse of time from when the tone generated by a respective one of said plurality of tone generating channels begins to decay, each of said truncate data representing the lapse of time of a respective member of said group of decay-time data.

5. An electronic musical instrument according to claim 2, wherein each of said tone data includes tone-pitch data representative of a tone pitch of the corresponding tone, said modifying means modifying each of said group of truncate data in accordance with corresponding one of said tone-pitch data.

6. An electronic musical instrument according to claim 2, wherein the tone data of each tone includes pitch data representing the pitch of the tone and wherein said modifying means includes a priority weighting means for causing the tone-data assigning priority to be a function of the pitch data of the tone data assigned to the respective tone generating channels.

7. An electronic musical instrument according to claim 2, wherein each of said tone data includes tone-pitch data representative of a tone pitch of the corresponding tone, and wherein said modifying means comprises tone range detecting means for detecting, with respect to each of said tone data, one of predetermined tone ranges to which the tone represented by said each of said tone data belongs, said modifying means modifying each of said group of truncate data in accordance with a respective one of said detected tone ranges.

8. An electronic musical instrument according to claim 7, wherein said modifying means modifies said group of truncate data such that the higher the tone range of the tone pitch of the assigned tone data becomes the lower the tone-data assigning priority of the corresponding tone generating channel becomes.

9. An electronic musical instrument comprising:

tone data generating means for generating tone data each representative of a tone to be generated;

tone generating means having a plurality of tone generating channels;

assigning means for assigning said tone data to said tone generating channels, each of said tone generating channels being assigned one of said tone data;

said tone data generating means further generating new tone data representative of a new tone; and channel detecting means for detecting, in accordance with said tone data, at least one of said tone generating channels which is to be prevented from a new assignment of said new tone data;

said assigning means further assigning said new tone data to one of remaining tone generating channels which are said tone generating channels except for said at least one of detected tone generating channel.

10. An electronic musical instrument according to claim 9, wherein each of said tone data includes tone-pitch data representative of a tone pitch of the corresponding tone, said channel detecting means detecting said at least one of said tone generating channels in accordance with said tone-pitch data.

11. An electronic musical instrument according to claim 10, wherein said channel detecting means detects said at least one of said tone generating channels in the order of pitches of the tones represented by said tone-pitch data from that of said tone generating channels to which the tone data including the tone-pitch data representative of the lowest one of the tone pitches is assigned.

12. An electronic musical instrument according to claim 9, wherein each of said tone data includes tone-pitch data representative of a tone pitch of the corresponding tone, said channel detecting means comprising tone range detecting means for detecting, with respect to each of said tone data, one of predetermined tone ranges to which the tone represented by said each of said tone data belongs, said channel detecting means detecting said at least one of said tone generating channels in accordance with said detected tone ranges.

13. An electronic musical instrument according to claim 12, wherein said channel detecting means detects said at least one of said tone generating channels in the order of tone ranges to which said tone data belong from that of said tone generating channels to which the tone data including the tone-pitch data representative of the tone pitch belonging to the lowest one of the tone ranges is assigned.

14. An electronic musical instrument according to claim 12, whereih said channel detecting means detects, as said at least one of said tone generating channels, those of said plurality of tone generating channels to which the tone data representing the tones below a predetermined tone pitch are assigned.

15. An electronic musical instrument according to claim 12, wherein said channel detecting means detects, as said at least one of said tone generating channels, those of said plurality of tone generating channels to which the tone data representing the tones above a predetermined tone pitch are assigned.

16. An electronic musical instrument according to claim 12, wherein said channel detecting means detects, as said at least one of said tone generating channels, those of said plurality of tone generating channels to which the tone data representing the tones within a predetermined tone range are assigned.

17. An electronic musical instrument according to claim 12 further comprising tone range designating means for designating a tone range, and wherein said channel detecting means detects, as said at least one of said tone generating channels, one or more of said plurality of tone generating channels to which the tone data representing the tones within said designated tone range are assigned.

18. An electronic musical instrument comprising:

tone data generating means for generating tone data each representative of a tone to be generated;

tone generating means having a plurality of tone enerating channels;

assigning means for assigning said tone data to said tone generating channels, each of said tone generating channels being assigned one of said tone data;

said tone data generating means further generating new tone data representative of a new tone;

truncate data storing means having storing portions corresponding to said tone generating channels for storing a group of truncate data; and new truncate data generating means responsive to said new tone data for generating new truncate data;

said assigning means comprising channel designating means which designates a specified channel of said tone generating channels in acordance with said group of truncate data and further assigning said new tone data and said new truncate data to said specified channel and to a storing portion corresponding to said specified channel among said storing portions, respectively, thereby causing said new tone data and said new truncate data to be respectively substituted for the previously assigned tone data in said specified channel and the previously stored truncate data in a respective storing portion corresponding to said specified channel.

19. An electronic musical instrument according to claim 18, wherein said channel designating means comprises determining means for determining, with respect to each of said tone generating channels, tone-data assigning priority representing priority of assignment of said new tone data to each of said tone generating channels in accordance with the magnitude of each data of said group of truncate data, and designates a tone generating channel corresponding to the tone-data assigning priority equal to a predetermined priority as said specified channel.

20. An electronic musical instrument according to claim 19, wherein each of said tone data includes tone-pitch data representative of a pitch of the tone to be generated, said new truncate data generating means generating said new truncate data based on the tone-pitch data included in the corresponding one of said tone data.

21. An electronic musical instrument according to claim 19, wherein each of said tone data includes tone-pitch data representative of a pitch of the tone to be generated, said new truncate data generating means comprising tone range detecting means responsive to each of said tone-pitch data for detecting one of predetermined tone ranges to which the tone represented by said each of said tone-pitch data belongs, said new truncate data generating means generating said new truncate data based on said tone range detected from the corresponding tone data generated by said tone data generating means.

22. An electronic musical instrument according to claim 19 wherein said tone data generating means comprises a keyboard having a plurality of keys and generates each of said tone data in response to depression of a key of said plurality of keys, each of said tone data includes touch data representing the depression strength applied to a corresponding key of said plurality of keys when the corresponding key is actuated, said new truncate data generating means comprising modifying means for modifying each of said new truncate data in accordance with the touch data included in the corresponding tone data to output modified new truncate data, said assigning means substituting said modified new truncate data for the truncate data stored correspondingly to said selected tone generating channel.

23. An electronic musical instrument according to claim 19, wherein said truncate data storing means comprises truncate data renewing means responsive to each of said tone data generated by said tone data generating means for renewing said truncate data so that all of the tone-data assigning priorities represented thereby are enhanced by a predetermined level.

24. An electronic musical instrument comprising:

tone data generating means for generating tone data each representative of a tone to be generated;

tone generating means having first to Nth tone generating channels;

assigning means for assigning said tone data to said tone generating channels, each of said tone generating channels being assigned one of said tone data and generating a tone signal represented by the assigned tone data; and detecting means for detecting redundant channels among said first to Nth tone generating channels to which the same tone data have been assigned and the number of such redundant channels;

said tone data generating means further including means for generating new tone data representative of a tone to be newly generated, said assigning means including means for preferentially assigning said new tone data to one of the redundant channels when the number of redundant channels in a group of redundant channels having a same particular tone data, including the one redundant channel, is greater than or equal to a predetermined integer K ($2 \leqq K \leqq N-1$) and when said new tone data is the same as the particular tone data assigned to the one redundant channel.

25. An electronic musical instrument according to claim 24, wherein said assigning means assigns said new tone data to one of said first to Nth tone generating channels when said number detected by said detecting means is less than said predetermined integer K.

26. An electronic musical instrument comprising:

mode selection means for selecting one of first and second operation modes;

tone data generating means for generating tone data each representative of a tone to be generated;

tone generating means having first to Nth tone generating channels and operating in one of said first and second modes;

assigning means for assigning said tone data to said tone generating channels, each of said tone generating channels being assigned one of said tone data and generating a tone signal represented by the assigned tone data; and detecting means for detecting one or more of said first to Nth tone generating channels to which tone data representative of a specific range of tones is assigned;

said tone data generating means further including means for generating new tone data representative of a tone to be newly generated, said assigning means being able to assign said new tone data to any one of said first to Nth tone generating channels when said mode selection means is selecting said first operation mode, said assigning means being blocked from assigning said new tone data to the one or more tone generating channels detected by said detecting means when said mode selection means is selecting said second operation mode.

27. An electronic musical instrument according to claim 26, wherein said tone data generating means comprises a keyboard having a plurality of keys and key depression detecting means for detecting depression and release of each key of said keyboard, said tone data generating means generating each of said tone data and said new tone data in response to each detection of depression of a key of said keyboard, each of said tone generating channels causing the tone signal generated thereby to decay when the release of the key corresponding to the tone data assigned thereto is detected by said key depression detecting means, each of said tone generating channels rendering the decay of tone signal more gentle when said mode selection means selects said second operation mode.

28. An electronic musical instrument according to claim 26, wherein said specific tones are the first the Kth ($K \geqq 2$) lowest-pitch ones among the tones represented by the tone data assigned to said tone generating channels.

29. An electronic musical instrument according to claim 26, wherein said specific tones are the first to Kth ($K \geqq 2$) highest-pitch ones among the tones represented by the tone data assigned to said tone generating channels.

30. An electronic musical instrument according to claim 26, wherein said specific tones are tones within a predetermined tone range.

31. A truncate prioritization system for determining which of a limited plurality of tone producing channels available to an electronic music generating instrument is to respond to a new tone request and thereby truncate a previously requested tone if such previously requested tone is still being produced, the system comprising:

priority assigning means for producing and assigning a priority number to each of the limited plurality of tone producing channels available to the instrument; and designating means, responsive to the priority numbers produced by the priority assigning means, for designating which one of the tone producing channels will respond to the new tone request;

wherein the priority assigning means includes a long duration sound recognizing means for recognizing one or more tones belonging to a long duration sound and assigning channels producing those one or more tones relatively high priority numbers so that the long duration sound will be protected from truncation.

32. A truncate prioritization system according to claim 31 wherein the recognizing means includes a pitch related weighting means for weighting the priority number of each channel according to a pitch value assigned to the respective previously designated tone of that channel.

33. A truncate prioritization system according to claim 31 wherein the recognizing means includes a lowest pitch detection means for detecting a group of one or more channels producing the lowest pitched tones among the tones being generated by the instrument and for assigning to the group of detected channels relatively high priority numbers so that their respective lowest pitched tones will be protected from truncation.

34. A truncate prioritization system according to claim 33 wherein the priority assigning means includes a smallest envelope detect means for detecting which of the remaining channels, not belonging to the lowest pitched group, is producing a tone with the smallest envelope among the tones being produced by the retaining channels.

35. A truncate prioritization system according to claim 31 wherein the priority assigning means includes means for protecting the most recently requested one of a set of previously requested tones from truncation.

36. A truncate prioritization system according to claim 31 wherein the priority assigning means includes means for protecting the highest pitched one of a set previously requested tones from being truncated.

37. A truncate prioritization system according to claim 31 wherein a plurality of depressable keys can be operably coupled to the instrument for requesting new tones and for designating the pitch of the newly requested tones, and wherein the priority assigning means includes means for protecting tones requested by still depressed ones of the keys from being truncated.

38. A truncate prioritization system according to claim 31 wherein the recognizing means includes a protected range defining means for defining a range of pitch values whose corresponding tones are to be assigned relatively high priority numbers and are to thereby be protected from truncation.

39. A truncate prioritization system according to claim 31 wherein the recognizing means is responsive to the tone color of previously requested tones.

* * * * *